US012628924B2

(12) United States Patent
Jessop

(10) Patent No.: US 12,628,924 B2
(45) Date of Patent: May 19, 2026

(54) MOBILE OFFICE SYSTEM APPARATUS AND METHODS OF USE

(71) Applicant: Base Case, LLC, Draper, UT (US)

(72) Inventor: Arthur M. Jessop, Draper, UT (US)

(73) Assignee: Base Case, LLC, Draper, UT (US)

( * ) Notice: Subject to any disclaimer, the term of this patent is extended or adjusted under 35 U.S.C. 154(b) by 0 days.

(21) Appl. No.: 19/033,421

(22) Filed: Jan. 21, 2025

(65) Prior Publication Data

US 2026/0020652 A1 Jan. 22, 2026

Related U.S. Application Data

(60) Provisional application No. 63/673,989, filed on Jul. 22, 2024.

(51) Int. Cl.
*A45C 11/00* (2006.01)
*A45C 5/14* (2006.01)
*A45C 15/00* (2006.01)

(52) U.S. Cl.
CPC ..... *A45C 11/003* (2025.01); *A45C 5/14* (2013.01); *A45C 15/00* (2013.01); *A45C 2200/15* (2013.01)

(58) Field of Classification Search
CPC ..... A45C 11/003; A45C 5/14; A45C 15/00; A45C 2200/15
USPC ..... 206/45.23, 504, 320; 361/679.01, 361/679.02; 190/18 R
See application file for complete search history.

(56) References Cited

U.S. PATENT DOCUMENTS

D305,686 S 1/1990 Fischer
D310,346 S 9/1990 Allred
4,980,848 A * 12/1990 Griffin ..... G06F 1/203 361/679.09
D360,621 S 7/1995 Schoening
D377,126 S 1/1997 Foco et al.
D378,677 S 4/1997 Matsumoto et al.
D395,041 S 6/1998 Leveridge et al.
5,806,940 A * 9/1998 Heirich ..... G06F 1/1601 361/679.61
D436,354 S 1/2001 Kodimer
D436,629 S 1/2001 Fawkes et al.
D448,370 S 9/2001 Kim
D448,371 S 9/2001 Kim
(Continued)

FOREIGN PATENT DOCUMENTS

CN 205103712 U 3/2016
CN 303931805 11/2016
(Continued)

OTHER PUBLICATIONS

"LG-Standby ME Go 27", Class LED Full HD Smart webOS Touch Screen with Briefcase Design (2023), Retrieved from https: //www.bestbuy.com/site/lg-stanbyme-go-27-class-led-full-hd-smart-webos-touch-screen-with-briefcase-design-2023/6563000.p?skuId=6563000, Retrieved on Jul. 25, 2025, p. 1.
(Continued)

*Primary Examiner* — Rafael A Ortiz
(74) *Attorney, Agent, or Firm* — Workman Nydegger

(57) ABSTRACT

A mobile office system for providing a mobile office suite can include one or more computer monitors and appropriate electronics, cables, ports, and wiring housed in a protective case that is simple to pack and carry with travel. The protective case allows for easy set-up and portability, and may include retractable stands for positioning the monitors.

23 Claims, 18 Drawing Sheets

(56) References Cited

U.S. PATENT DOCUMENTS

| | | | | |
|---|---|---|---|---|
| 6,343,006 | B1 | 1/2002 | Moscovitch et al. | |
| 6,362,954 | B1 | 3/2002 | Levander | |
| D455,745 | S | 4/2002 | Kim | |
| D469,746 | S | 2/2003 | Soule, Jr. | |
| D489,716 | S | 5/2004 | Kim | |
| D493,463 | S | 7/2004 | Takahashi | |
| D496,363 | S | 9/2004 | Ozolins et al. | |
| 6,811,006 | B1 * | 11/2004 | Mundle | A45C 13/02 190/18 R |
| D499,704 | S | 12/2004 | Song | |
| D510,920 | S | 10/2005 | Tandberg et al. | |
| 7,353,943 | B2 * | 4/2008 | Evans | A63D 15/10 190/18 R |
| D587,710 | S | 3/2009 | Han | |
| D587,711 | S | 3/2009 | Han | |
| D589,511 | S | 3/2009 | Han | |
| D589,958 | S | 4/2009 | Han | |
| D589,959 | S | 4/2009 | Han | |
| D615,054 | S | 5/2010 | Mellingen et al. | |
| D615,082 | S | 5/2010 | Taichi | |
| D623,621 | S | 9/2010 | Roed et al. | |
| D641,047 | S | 7/2011 | Tahara et al. | |
| 8,016,089 | B1 * | 9/2011 | McNichols | A45C 5/14 190/18 R |
| D650,777 | S | 12/2011 | Suzuki et al. | |
| D650,778 | S | 12/2011 | Suzuki et al. | |
| 8,462,103 | B1 | 6/2013 | Moscovitch et al. | |
| D696,252 | S | 12/2013 | Batio | |
| 8,602,217 | B2 * | 12/2013 | Sosnovsky | B65D 21/0228 220/756 |
| D712,142 | S | 9/2014 | Bayley | |
| D742,342 | S | 11/2015 | ØStensen et al. | |
| D768,131 | S | 10/2016 | Kuo | |
| D841,598 | S | 2/2019 | Adenau | |
| D841,602 | S | 2/2019 | Adenau | |
| 10,353,427 | B1 * | 7/2019 | Rabb | A45C 7/0022 |
| D913,727 | S | 3/2021 | Howell | |
| 10,976,779 | B1 | 4/2021 | Tsai et al. | |
| D939,854 | S | 1/2022 | Smullen et al. | |
| 11,507,142 | B1 * | 11/2022 | Davis | G06F 1/1656 |
| D973,610 | S | 12/2022 | ØStensen et al. | |
| 11,681,333 | B2 * | 6/2023 | Yao | G06F 1/1601 361/679.01 |
| 11,768,524 | B2 * | 9/2023 | Siddiqui | H04M 1/0268 361/679.01 |
| D1,023,311 | S | 4/2024 | Qu | |
| D1,023,624 | S | 4/2024 | Chong et al. | |
| D1,023,627 | S | 4/2024 | Chong et al. | |
| D1,028,968 | S | 5/2024 | Brown et al. | |
| D1,034,599 | S | 7/2024 | Ono | |
| D1,039,607 | S | 8/2024 | Terzian | |
| D1,048,713 | S | 10/2024 | Laskar | |
| D1,068,343 | S | 4/2025 | Brown et al. | |
| D1,069,398 | S | 4/2025 | Kanaan | |
| D1,115,759 | S | 3/2026 | Albertson | |
| 2004/0035639 | A1 * | 2/2004 | Elhadiri | F01M 11/04 184/1.5 |
| 2005/0051982 | A1 * | 3/2005 | Su | A63B 55/53 280/47.26 |
| 2005/0137942 | A1 | 6/2005 | LaFleur | |
| 2010/0163358 | A1 * | 7/2010 | Tsai | A45C 13/385 190/18 R |
| 2013/0077228 | A1 | 3/2013 | Batio | |
| 2015/0363017 | A1 | 12/2015 | Sitbon | |
| 2019/0380213 | A1 | 12/2019 | Liu et al. | |
| 2020/0222816 | A1 * | 7/2020 | Mercier | G06F 1/1632 |
| 2020/0367622 | A1 * | 11/2020 | Wu | A45C 5/03 |
| 2021/0112939 | A1 * | 4/2021 | Tsui | A45C 11/00 |
| 2021/0245064 | A1 * | 8/2021 | Cragg | A45C 9/00 |
| 2021/0245065 | A1 * | 8/2021 | Reichert | A63F 13/90 |
| 2021/0365067 | A1 | 11/2021 | Liu | |
| 2022/0322798 | A1 * | 10/2022 | Lesperance | A45C 5/14 |
| 2022/0333731 | A1 * | 10/2022 | Barlettano | F16M 11/10 |
| 2023/0148710 | A1 * | 5/2023 | Redon | A43C 11/20 24/68 SK |
| 2023/0168712 | A1 * | 6/2023 | Kim | H05K 5/03 361/679.01 |
| 2023/0221778 | A1 * | 7/2023 | Jochai | G06F 1/1601 361/679.02 |
| 2023/0305597 | A1 | 9/2023 | Jane | |

FOREIGN PATENT DOCUMENTS

| | | | |
|---|---|---|---|
| CN | 201930298273.2 | S | 4/2020 |
| CN | 202030688154.0 | S | 8/2021 |
| CN | 202130342580.3 | S | 10/2021 |
| CN | 202130382711.0 | S | 11/2021 |
| CN | 202230018218.5 | S | 5/2022 |
| CN | 202230102476.1 | S | 5/2022 |
| CN | 116471781 | A | 7/2023 |
| CN | 308143994 | | 7/2023 |
| CN | 309405100 | | 7/2025 |
| DE | 202024100362 | U1 | 1/2024 |
| EM | 7827258-0001 | | 1/2023 |
| GE | 777 | | 4/2014 |

OTHER PUBLICATIONS

"POGA, Products", Retrieved from https://poga.gg/, Retrieved on Jul. 25, 2025, pp. 2.

International Search Report and Written Opinion received for PCT Patent Application No. PCT/US2025/038741, mailed on Nov. 25, 2025, 18 pages.

Executive 23.8 Dual Screen UHD/4K Command Center, Base Case, getbasecase.com, published by Base Case, available on Jul. 19, 2025 on wayback machine ©2026 Base Case, online, visited Mar. 20,2026. URL: https://getbasecase.com/products/the-executive-uhd (Year: 2025).

Delta CarryGo, UPERFECT, uperfect.com, published by UPERFECT, published by UPERFECT, date unlisted © unlisted, online, visited Mar. 20, 2026. URL: https://uperfect.com/products/delta-carrygo (Year: 2026).

T50 Ground Control Station, CHINOWING, chinowing.com, author unlisted, published on Mar. 19, 2024 ©2019 Shenzhen Huazhiyi Technology Co., Ltd, online, visited Mar. 21, 2026. URL: https://www.chinowing.com/en/h-nd-93.html (Year: 2024).

Non-Final Office Action received for U.S. Appl. No. 30/003,108, mailed on Apr. 2, 2026, 22 pages.

* cited by examiner

MOBILE OFFICE SYSTEM APPARATUS AND METHODS OF USE

CROSS-REFERENCE TO RELATED APPLICATIONS

This application claims the benefit of and priority to U.S. Provisional Application No. 63/673,989, entitled MOBILE OFFICE SYSTEM APPARATUS AND METHODS OF USE, filed on Jul. 22, 2024, the entirety of which is incorporated herein by reference.

BACKGROUND OF THE INVENTION

1. Technical Field

This invention relates to a system for mobile office productivity solutions.

2. Background and Relevant Art

Conventional portable screens and travel products aimed at providing productivity enhancements or accessibility benefits have been developed to help people who travel but traditionally have to give up one aspect or another to accomplish its portability or useability. Often, the devices may require multiple cables and connectors to operate properly. Further, portable devices often need to be packed into luggage, which may necessitate larger luggage that may be less suitable for carry-on. Additionally, these devices may involve using smaller or less feature complete versions of devices or systems normally used in an office setting. These smaller versions may be more difficult to work with and do not enable productivity.

Accordingly, there are a number of disadvantages in the art that can be addressed.

BRIEF SUMMARY OF THE INVENTION

Implementations of the invention relate generally to systems, components, and methods for providing a mobile office, in particular, a mobile office system that enables the deployment of one or more monitors in a travel-ready, protective luggage case. The mobile office system may include one or more monitors securely coupled within the protective luggage case. The luggage case can provide a carry-on size profile while maintaining room for further connection accessories and other luggage capacity.

For example, a mobile office system can include a protective case, a first chassis selectively secured to the inside of the protective case, a first computer monitor selectively secured to the first chassis, and a power cable operably connected to the monitor. A data cable can be operably connected to the monitor. In one embodiment, a mobile office system has a stowed state and a deployed state. The deployed state can be configured to present the first computer screen for external viewing.

In addition, a mobile office system can include a protective case having a first shell and a second shell, where the first shell and the second shell are in hinged communication. The protective case can include a deployed state and a stowed state. The mobile office system can also include a first chassis selectively secured to the first shell, and a second chassis that is selectively secured to the second shell. In addition, the mobile office system can include a first computer monitor selectively secured to the first chassis and a second computer monitor selectively secured to the second chassis where the first computer monitor and the second computer monitor are within an internal space of the first shell or the second shell even in the deployed state. Furthermore, the mobile office system can include a first leg in mechanical communication with the first shell, and a second leg in mechanical communication with the second shell, such that the first and second legs are configured to support the mobile office system. Still further, the mobile office system can include an interface configured for external operation and to facilitate the transfer of power and data to and from the mobile office system. In such an embodiment, a power cable and a data cable are operably connected to the first and second computer monitors.

Similarly, a method of application for a mobile office system can include a first act of securing a first computer monitor to a first shell of a protective case. The method can also include securing a first leg to the first shell of the protective case. In addition, the method can include securing a second computer monitor to a second shell of the protective case. Furthermore, the method can include securing a second leg to the second shell of the protective case. Still further, the method can include coupling the first shell to the second shell with a hinge. Yet still further, the method can include operably connecting the first computer monitor and second computer monitor to a dock, and operably connecting an electronic device to the dock.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Implementations of the present invention extend to systems, components, and methods for providing a mobile office, in particular a mobile office system that enables the deployment of one or more monitors in a travel-ready, protective luggage case. The mobile office system may include one or more monitors securely coupled within the protective luggage case. The luggage case can provide a carry-on luggage size profile while maintaining room for further connection accessories, as well as other luggage capacity.

In particular, mobile office systems of the present disclosure provide a user with an efficient, office-like experience in a travel-ready solution. In one embodiment, a mobile office system is designed to provide a dual-screen productivity experience while also being portable and protected during travels. For example, the mobile office systems disclosed herein can have a deployed state and a stowed state. The deployed state allows for the use of the internal screens and other components, while the stowed state presents the mobile office system as a travel-like case, similar to a suitcase, carry-on, storage crate, or the like. Additionally, the outer protective case of the mobile office systems can be rigid and water resistant to protect the internal components from impacts during travel or inclement weather/conditions.

The system can include a suitcase or protective case that houses two computer monitors (or screens) that are height adjustable. Stands or legs can be retractable, foldable, or couplable to the mobile office system to provide stability for the system. These stands or legs can also be stowable within internal portions of the protective case. Additionally, the legs can ensure the screens are raised for proper ergonomic posture and provide the ability to utilize a laptop in conjunction with the mobile office system. A traveler or user that deploys such a mobile office system would appreciate the adjustability and usability of a mobile office system in its deployed state.

Mobile office systems of the present disclosure can include power and data cables that easily extend or retract from the system, while otherwise being maintained within the chassis, as well as input/output ports (i/o) that allow for the connection of a variety of power and data cable types. In some implementations, only one cable is needed to connect a device to the mobile office system. This limited cable nature can be further increased in the embodiment of the mobile office systems that allow for wireless connectivity to the screens and battery-based operation.

Figure 1A:
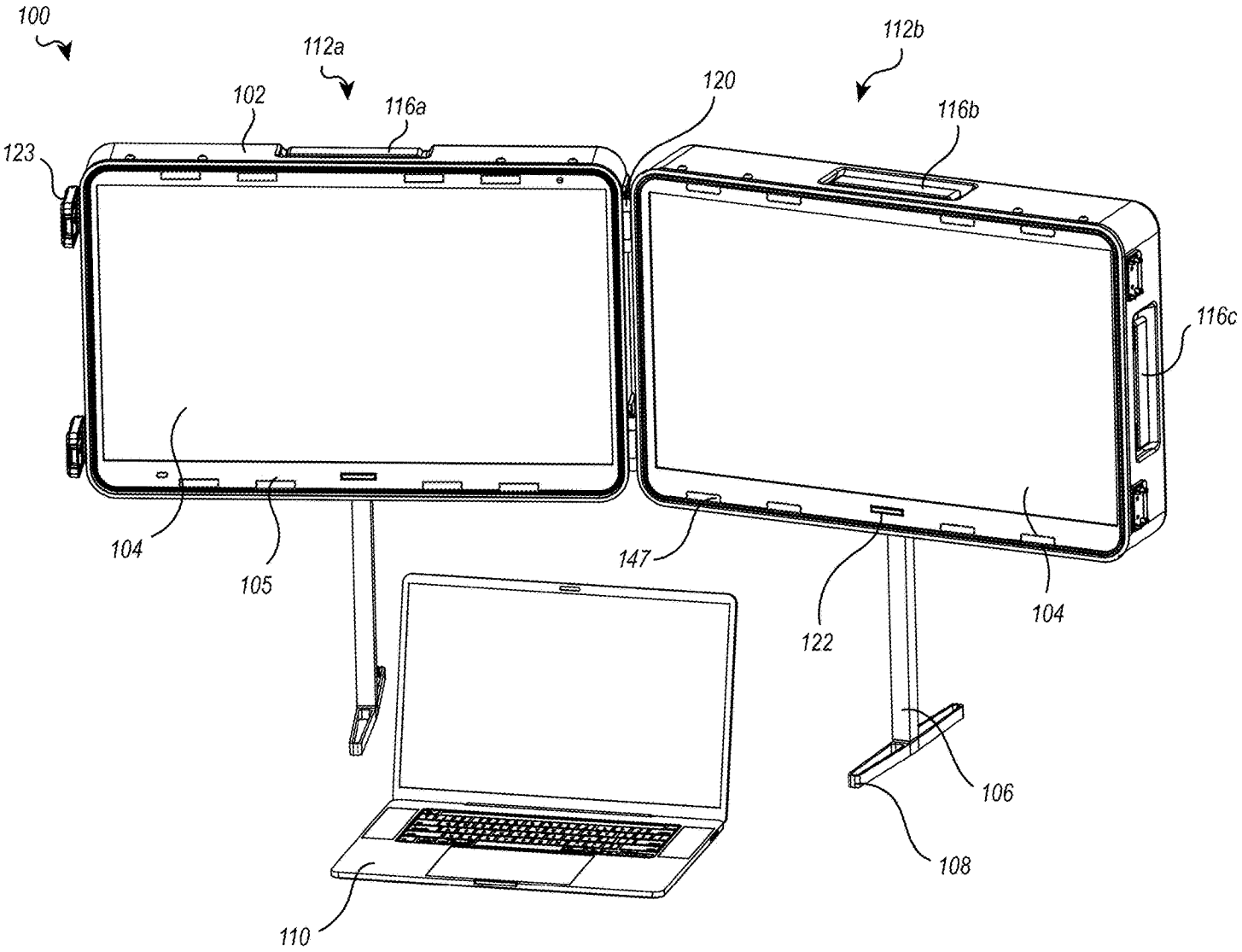
FIG. 1A illustrates a perspective view of a deployed mobile office system of the present disclosure.

FIG. 1A illustrates a perspective view of a deployed mobile office system 100. Mobile office system 100 can have a protective case 102, one or more screens 104, one or more legs 106, and one or more feet 108. FIG. 1A shows computer 110 in relation to mobile office system 100. As shown, mobile office system 100 is in a deployed state. A deployed state can mean that protective case 102 is opened and that protective case 102 is positioned by a user so that they can view the one or more screens. It also can mean that one or more legs 106 are deployed and supporting protective case 102. FIG. 1A also shows that release 122 can be disposed onto an inner surface of the protective case 102. Release 122 can enable the extension or retraction of legs 106. Since release 122 is internally mounted, a user can ensure leg 106 only extends when protective case 102 is opened. This placement ensures that a user deploys legs 106 intentionally and not accidentally when bumped during travel activities.

Leg 106 can be spring-loaded when stored. This means a user can press release 122, which can lead leg 106 to be urged outwards, allowing the user to capture and manipulate the leg. Each shell of the present disclosure can include one or more legs and releases. In one embodiment, leg 106 can include one or more notches or slots that enable a user to lock the leg into place, whether in a stowed position or in a deployed position. In such an example, leg 106 can have multiple deployable lengths. These deployable lengths can define a height at which the screen will sit relative to the surface on which the mobile office system is positioned. For example, a user can position the screens of a mobile office system to a height of 1 inch to 18 inches relative to the surface on which the mobile office system is positioned.

FIG. 1A further shows that protective case 102 can comprise a multipart case with one or more shells 112 (e.g., 112*a-g*), such as first shell 112*a* and a second shell 112*b*. A manufacturer can hingedly connect the first shell 112*a* to the second shell 112*b* using one or more hinges 120. As shown, two hinges 120 can secure the first shell 112*a* to the second shell 112*b*. In at least one embodiment, a larger or longer single hinge connects the first shell to the second shell. A manufacturer can install hinges 120 to the bottom edge of each the first shell and the second shell. A user will appreciate this hinge installation location as, when deployed, the screens are presented in a landscape orientation, similar to how a stand typically orients a computer monitor or screen.

In addition, hinge 120 can be transfer hinges. For example, transfer hinges can comprise electrical wiring embedded within the hinge hardware, to thereby enable the passing of power or data from the first shell 112*a* to the second shell 112*b*. In the case of two hinges 120, a manufacturer can enable one hinge 120 to transfer power while the second hinge 120 transfers data. A user will appreciate the seamless connectivity provided by including transfer hinges, as no additional wires or connections would be needed to ensure data and power connections between screens 104. A user can use hinges 120 to present screens 104 with an inwards angle or in a similarly ergonomic orientation.

In an embodiment where no transfer hinges are implemented, a manufacturer can instead ensure that all screens within the mobile office system 100 are wired together with power and data. For example, a manufacturer can run a wired connection between the first shell 112*a* and the second shell 112*b* that has sufficient length to allow for the deployment of the mobile office system. A manufacturer can install this wiring so that it remains retained within the mobile office system 100 when stowed and does not require a user to connect or disconnect it.

FIG. 1A shows that mobile office system 100 can also include one or more bezels 105. Bezels 105 can be designed to frame screens 104. In other words, bezel 105 can be designed to be installed around the front or perimeter of a screen 104. In one embodiment, bezels 105 can include one or more vents 147 that allow the passage of air between the outside air and the air inside the mobile office system. A manufacturer can install vents 147 along the outer most edge of a bezel.

FIG. 1A further shows that first shell 112*a* and second shell 112*b* each can have a handle 116*a* and 116*b* secured to the side opposing their connected legs 106. As shown in FIG. 1A, handles 116(*a-b*) are secured into a recessed cavity so that when handles 116(*a-b*) are not in use, their outer face is flush with the side face of its respective shell. In another embodiment, a manufacturer can secure handles 116(*a-b*) to the side face of each shell member such that handles 116(*a-b*) do not sit flush with the sides but rather protrude. FIG. 1A shows handles 116*a*, 116*b*, and 116*c* embedded or recessed into their respective shells.

A manufacturer can install folding, telescoping, expanding, rigid, fabric, or similar styles of handles to the first shell and second shell. A user of mobile office system 100 will appreciate the inclusion of both handles 116(*a-b*) (one on the first shell and the second on the second shell). For example, a user deploying mobile office system 100 can take hold of both handles 116(*a-b*) to assist in opening and orienting the mobile office system 100 to display screens 104 according to their desires. Another handle 116*c* can be embedded onto a different side of second shell 112*b* to assist in lifting mobile office system 100.

FIG. 1A illustrates that first shell 112*a* and second shell 112*b* each can have a portion of a securing mechanism 123. FIG. 1A also shows two securing mechanisms 123 where a clamping side is secured to the first shell 112*a* and a coupling side is secured to the second shell 112*b*. In such a configuration, a user can use hinges 120 to rotate the first shell 112*a* into alignment with the second shell 112*b* to allow the clamping side of securing mechanisms 123 to interface with the coupling side of securing mechanism 123, wherein the interfacing included the locking or securing of the two elements together. In at least one embodiment, a manufacturer can embed a key lock into one or more of the securing mechanisms.

Securing mechanisms 123 can enable the sealing of the protective case 102. Manufacturers can include an O-ring or gasket style seal into the edges of the first shell and second shell to allow the locking or securing of securing mechanisms 123 to seal protective case 102. Mobile office systems of the present disclosure can have an ingress protection (IP) rating of IP66. The first digit (6) indicates the device is completely dust-tight on a scale from 0 (no protection) to 6 (complete protection against dust ingress). The second digit (6) signifies the device is protected against powerful water jets on a scale from 0 (no protection) to 9 (protection against close-range high-pressure and high-temperature spray downs). In another example, the mobile office system 100 can have any combination of IP(1-6)(1-9) protection. A user will appreciate that for a device to achieve this rating, some standards may require the enclosure(s) to be tightly sealed, often using gaskets or O-rings to block dust and water entry, and such a rating makes mobile office systems of the present disclosure ideal for harsh environments that may be faced during travels.

Figure 1B:
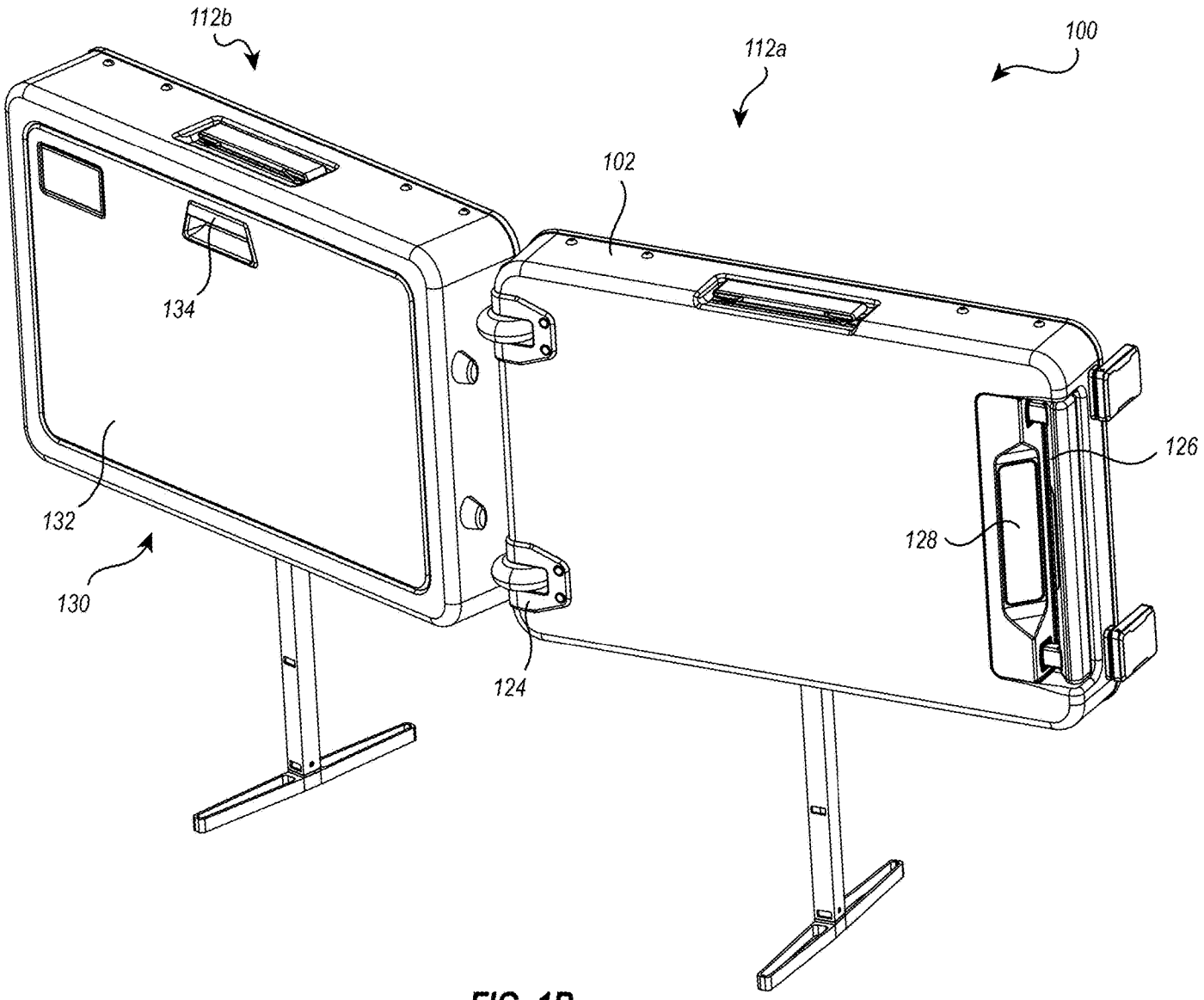
FIG. 1B illustrates a rear perspective view of the mobile office system of FIG. 1A.

FIG. 1B illustrates a rear perspective view of mobile office system 100. As shown, mobile office system 100 can have one or more wheels 124. A user will appreciate that the wheels 124 allow a user to roll their system 100 along a floor or surface rather than having to carry the system. A manufacturer can install various wheel types, including but not limited to inline, spinner (or similar 360-degree bearing wheels), ball, recessed, oversized, or the like. FIG. 1B shows wheels 124 mounted to the hinged end of the protective case 102, but a manufacturer can mount or secure wheels 124 to any side or edge of the protective case 102.

In a given embodiment, a manufacturer can embed handle 126 into either the first shell 112*a* or the second shell 112*b*. Handle 126 can comprise a telescoping or extending member configured to allow protective case 102 to be rolled on a floor or surface. Handle 126 can perform a similar role to extending handles or trolley handles of conventional roller bags or carry-on-style suitcases. A user can extend handle 126 out from its containment within an inner portion of the protective case 102 and use handle 126 and its extension members to pull the mobile office system 100 along the floor or similar surfaces.

In one embodiment, a manufacturer can install I/O ports on handle 126, such as a power or data port. For example, a user of such a mobile office device can charge their phone or similarly access the operation of a mobile office device through the handle. In another embodiment, a manufacturer can instead install handle 126 adjacent to a scalable I/O interface 128. Interface 128 can have ethernet, USB, auxiliary, HDMI, DVI, power, or similar-style data and/or power ports. FIG. 1B shows a flexible or rigid protective cover secured to the outside face of interface 128 to prevent the ingress of debris or fluids when not in use.

FIG. 1B shows storage compartment 130. The storage compartment 130 can include an inner volume, a door 132, and a latch 134. Storage compartment 130 can be constructed from the same or a similar material as protective case 102. FIG. 1B shows storage compartment 130 being oriented to open along the long side of second shell 112*b*. In another embodiment, a manufacturer can orient door 132 to open along any given side of the shell. However, a user of mobile office system 100 would appreciate the illustrated configuration of storage compartment 130 as they can access the contents stored within the inner volume even in the deployed state of mobile office system 100. The inner volume can include compartments or volumes of different sizes or techniques (fabrics, molded compartments, baffles, or the like). Storage compartment 130 adds to the overall portability and travel usefulness of mobile office system 100 by allowing users to bring important documents, travel necessities, or similar without needing a secondary bag.

Figure 2:
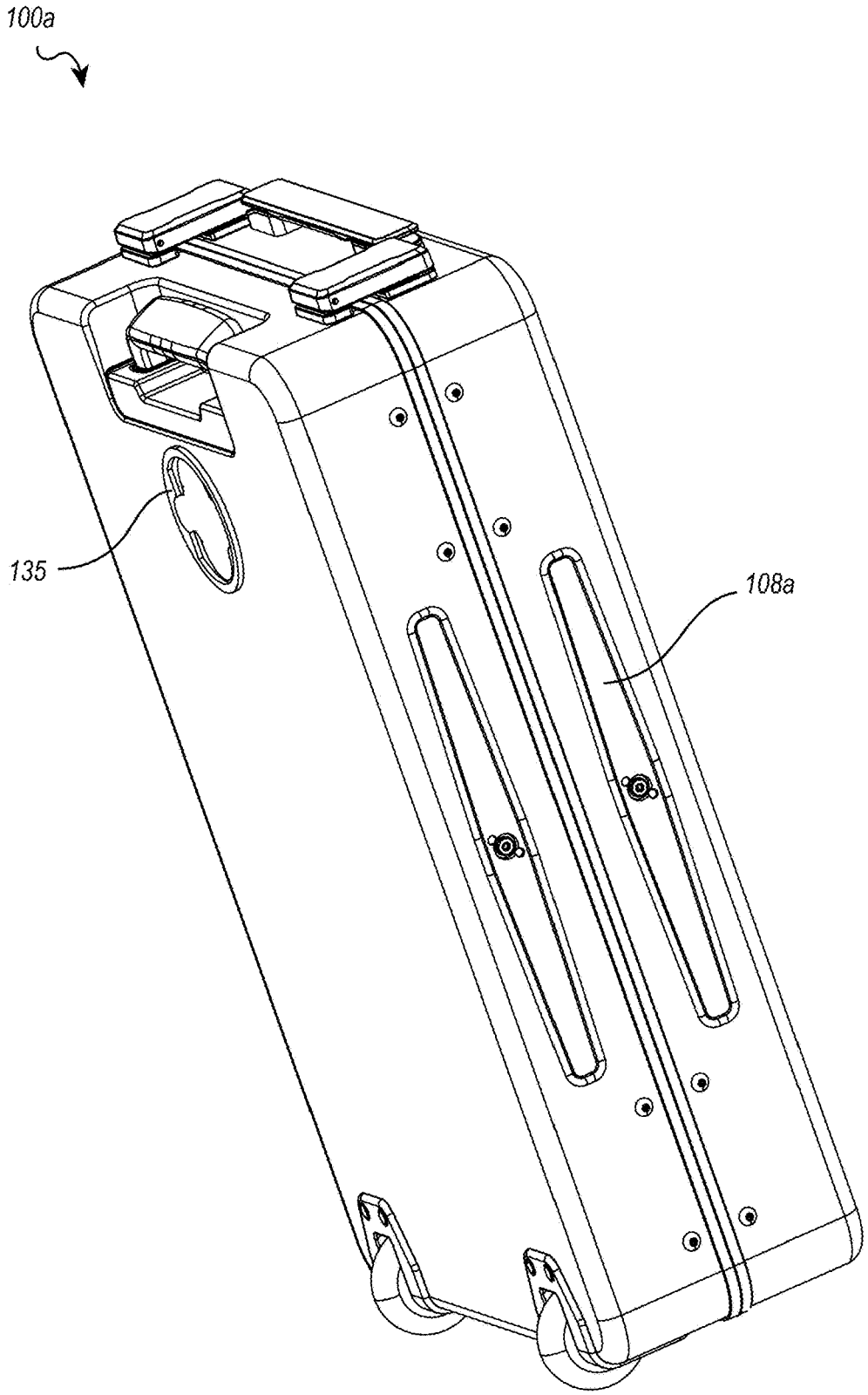
FIG. 2 illustrates a mobile office system of the present disclosure in a stowed state.

FIG. 2 illustrates a side perspective view of mobile office system 100*a* in a stowed state. A stowed state can mean that the first shell and the second shell are secured and sealed together. Feet 108 can be secured to legs (not seen), which are secured and recessed inside an internal portion of mobile office system 100*a*. The outermost edge of feet 108*a* can is flush with the outer edge of the protective case. In some embodiments, this outermost edge can be where the foot contacts the surface (such as a table or desk) that a mobile office system 100*a* rests on in a deployed state. A user can rotate feet 108*a* once the legs have been deployed to support the weight of the mobile office system 100*a* and prevent the system from being easily knocked over.

Feet 108 (e.g., feet 108*a-e*) of the present disclosure can interface with or include a spring detent. The spring detent can allow a user to rotate and secure the feet into a predefined orientation. For example, a user can rotate the feet 108 about 45 degrees or 90 degrees relative to their stowed position (a stowed position can mean the feet 108 are oriented parallel with the length of the protective case). In at least one embodiment, the feet 108 of the present disclosure have a grip material disposed on the surface that contacts the mounting surface to provide extra stability.

FIG. 2 further shows a side aspect of a spool system 135. As previously disclosed, a manufacturer can include a spring-loaded spool system to retain a power cable and/or a data cable that a user may extend.

Figures 3A, 3B, 3C, 3D:
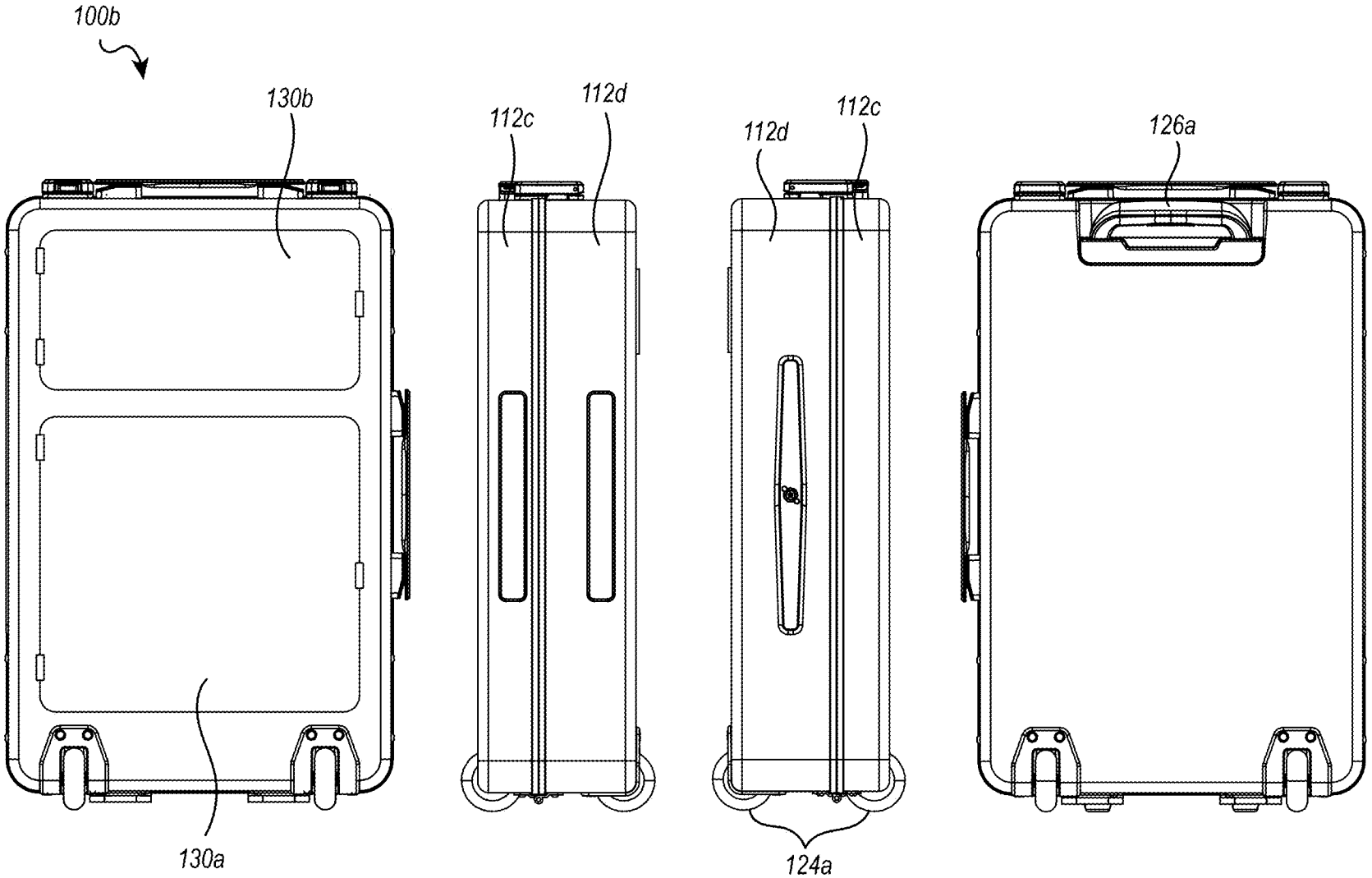
FIG. 3A illustrates a front, facing view of a stowed mobile office system of the present disclosure.
FIG. 3B illustrates a left-side view of a stowed mobile office system of the present disclosure.
FIG. 3C illustrates a right-side view of a stowed mobile office system of the present disclosure.
FIG. 3D illustrates a rear, facing view of a stowed mobile office system 100 of the present disclosure.

FIGS. 3A, 3B, 3C, and 3D illustrate various face views of stowed mobile office system 100*b*. Specifically, FIG. 3A illustrates a front face, FIG. 3B illustrates a left face, FIG. 3C illustrates a right face, and FIG. 3D illustrates a back face of mobile office system 100*b*. FIG. 3A shows two storage compartments, 130*a* and 130*b*. Unlike storage compartments 130, storage compartments 130*a* and 130*b* have smaller and distinct internal volumes and are accessed by separate and distinct doors.

FIGS. 3B and 3C illustrate the first shell 112*c* and the second shell 112*d*. First shell 112*c* is thinner than second shell 112*d*. As shown in previous embodiments, the first shell and second shell can have similar thickness, and, in at least one embodiment, the second shell is thinner than the first shell. A manufacturer can vary the thickness of each shell depending on the internal components and the available internal storage compartments. FIG. 3B shows that the second shell 112*d* is thicker to account for the inclusion of storage compartments 130*a* and 130*b*.

As shown in FIGS. 3A-3D, wheels 124*a* are mounted to the four corners of the protective case, i.e., two are mounted on the lower edge of the first shell, and two are mounted on the lower edge of the second shell. Additionally, FIGS. 3A-3D show that handle 126*a* is partially extended.

Figure 4B:
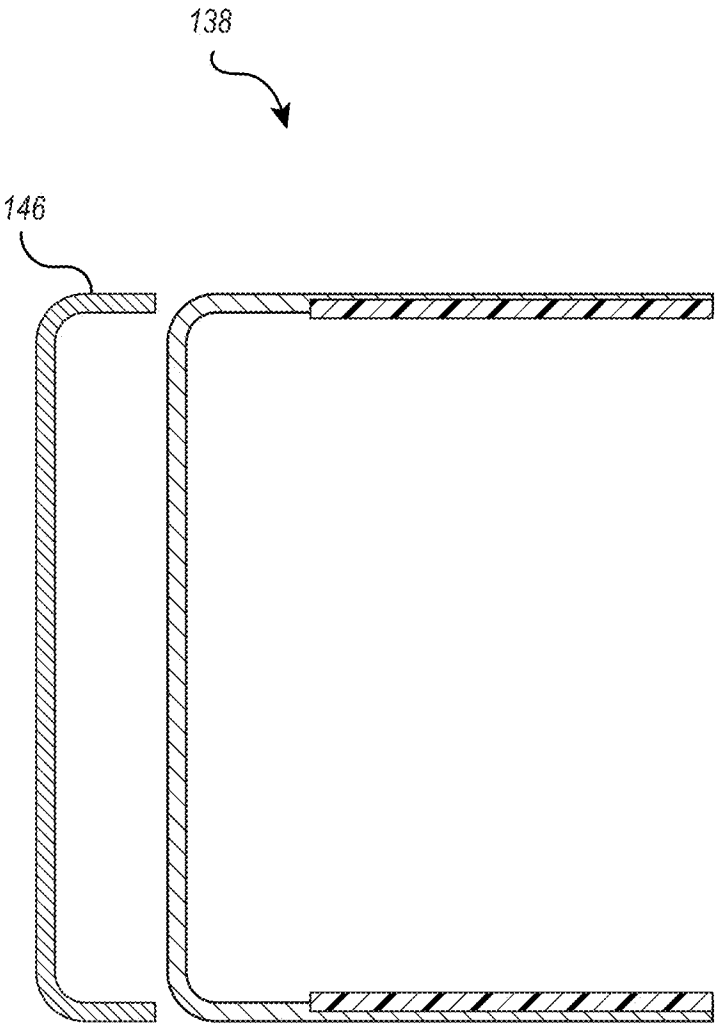
FIG. 4B illustrates a cross-sectional view in which a manufacturer secures a second part or key to right and left edges of the screen illustrated in FIG. 4A.
Figure 4A:
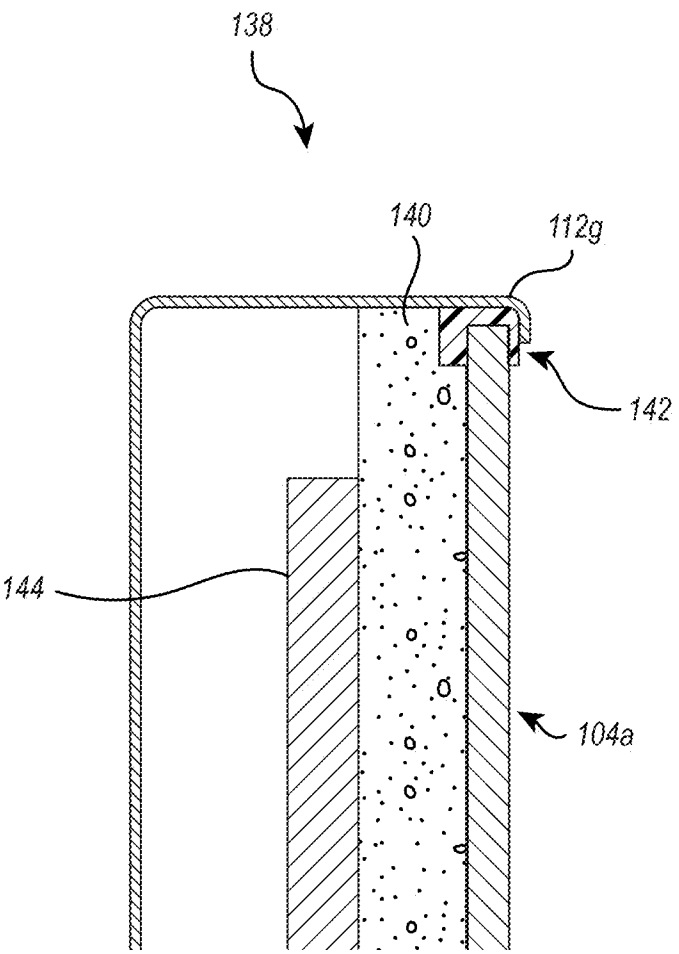
FIG. 4A illustrates a side, cross-sectional view of a mounted computer screen of the present disclosure.

FIGS. 4A and 4B illustrate views of an assembly for mounting a screen. Specifically, FIG. 4A illustrates a side cross-sectional view of assembly 138. Assembly 138 can include housing 142, screen 104*a*, housing 140, and shell 112*g*. Assembly 138 can be a portion of a first shell or second shell of the present disclosure. A manufacturer can secure a housing 142 (e.g. rubber) to the perimeter of screen 104*a*. Housing 142 can provide shock absorption or dampening due to the inherent characteristics of the chosen material. Housing 142 can have a channel that is designed to allow a manufacturer to slot screen 104*a* into the channel. Housing 142 can be multipart and designed to only mount to the top and/or bottom edge of screen 104*a*, wherein a manufacturer secures a second part or key 146 to the right and left edges of screen 104*a*. Shell 112*g* can be the first or second shell of a protective case. In at least one embodiment, housing 142 is a single piece that a manufacturer can stretch around screen 104*a* during installation. Shell 112*g* can then have a curved lip that wraps around the front of housing 142 and retains housing 142 and screen 104*a* with the internal space of shell 112*g*.

FIG. 4A shows housing 140 (e.g. foam) that can comprise a backer for housing 142 and screen 104*a*. Housing 140 can be (or otherwise be designed to have a) friction fit into shell 112*g*. In at least one embodiment, housing 140 is secured to shell 112*g* through adhesives, fasteners, etc. FIG. 4A shows housing 140 secured to or abutted with stand housing 144. In at least one embodiment, a manufacturer can secure stand housing 144 to shell 112*g*. Stand housing 144 is designed to retain a leg and or foot of the present disclosure. For example, a manufacturer can install a sliding track leg or telescopic leg within stand housing 144, allowing the leg to be stowed inside shell 112*g* during travels or the moving of the mobile office system.

FIGS. 5A-5D illustrate a left shell's (shell 112*e*) side and front views, as well as a right shell's side and front views (shell 112*f*), showing elements similar to those in FIGS. 4A-4B. Specifically, 5A and 5B show a first shell 112*e* of a mobile office system with a telescoping leg 106*a* extending out from stand housing 144. A user can selectively extend leg 106*a* to various heights, and at any of the chosen heights (or in the stowed position), the user can secure or lock leg 106*a* into place. A user can also manipulate or rotate a foot that attaches to leg 106*a* to a position that prevents the first shell 112*e* from being knocked over.

Figure 5A:
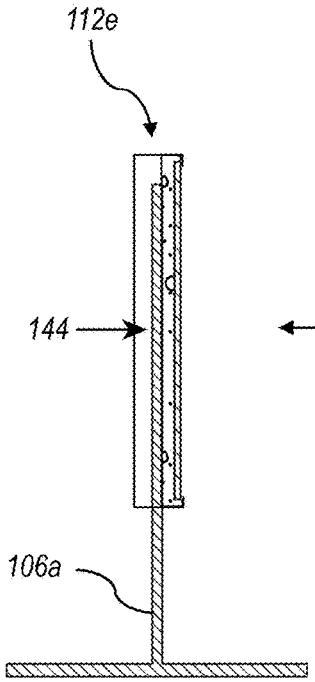
FIG. 5A illustrates a side view of a first shell of the present disclosure, further showing an extended leg.
Figure 5B:
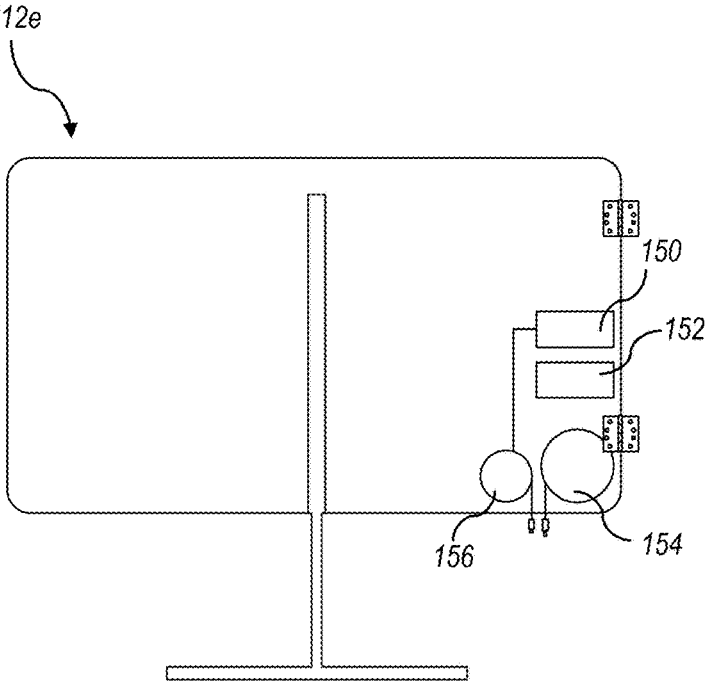
FIG. 5B illustrates a facing view of a first shell of the present disclosure.

FIG. 5B illustrates a facing view of a first shell of the present disclosure. In particular, FIG. 5B shows a back x-ray view into the first shell 112*e*. A manufacturer can couple a reeled data connector 156 (e.g. Thunderbolt, USB, HDMI, etc.), a reeled power connector 154, a power converter 152, and a dock 150 to the walls/side of the left shell 112*e* to a housing (see FIGS. 4A and 4B) or directly to the back of a screen. A manufacturer can include dock 150 to operably connect one or more screens together, a power converter 152 to power one or more screens, and the reeled power and data connectors 154 and 156 to operably connect an electronic device to one or more screens. In at least one embodiment, the reeled connectors can be ports. In another embodiment, a manufacturer can include a WIFI, Bluetooth, or similar wireless protocol module for wireless connectivity to one or more screens.

Figure 5C:
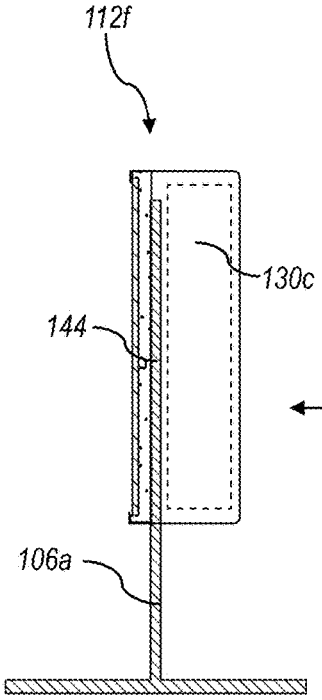
FIG. 5C illustrates a side view of a second shell of the present disclosure.
Figure 5D:
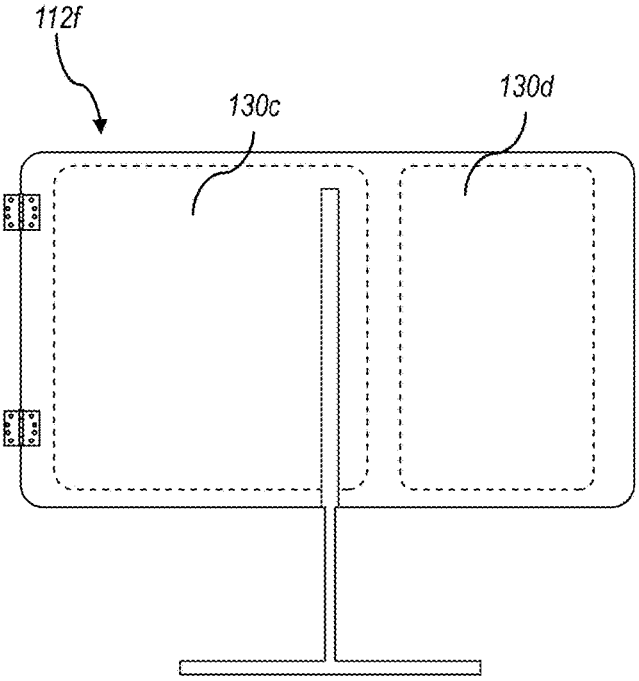
FIG. 5D illustrates a facing view of a second shell of the present disclosure.

FIG. 5C shows the second shell 112*f* that can be hingedly connected to the first shell 112*e*. Second shell 112*f* has another stand housing 144, another leg 106*a*, and storage compartments 130*c* and 130*d*. Second shell 112*f* can comprise additional electronics, wiring, or devices that enable the usability of the screen secured within it. Users can access storage compartments 130*c* and 130*d* from an attached access or door (see FIG. 5D). Storage compartments 130*c* and 130*d* can have sub-compartmentalization or be single volumes of internal space. A user can use storage compartments 130*c* and 130*d* to store a laptop or electronic device, paperwork, toiletries, clothing, or other traveling items.

Figure 6A:
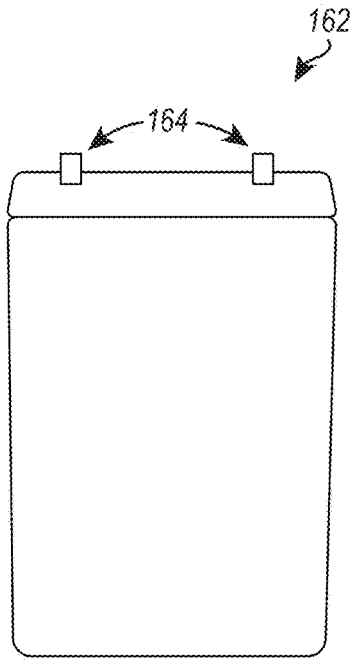
FIG. 6A illustrates a storage container of the present disclosure.
Figure 6B:
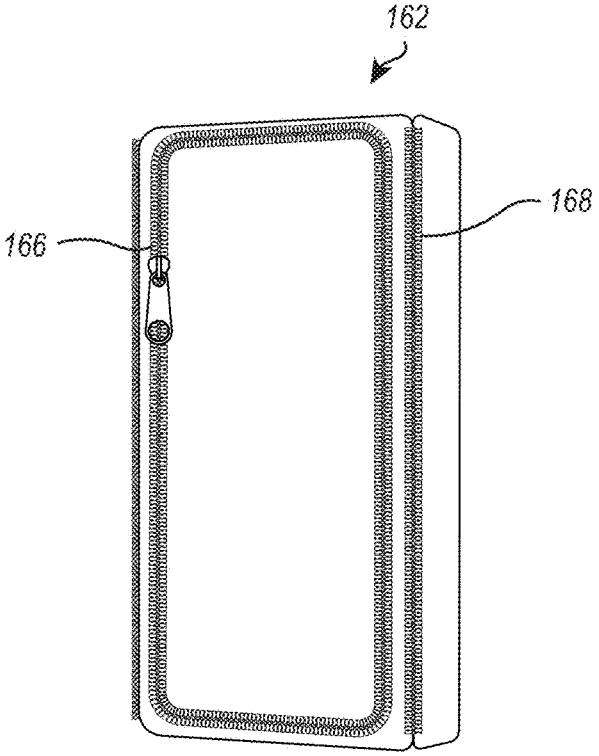
FIG. 6B illustrates a storage container of the present disclosure.

FIGS. 6A-6D illustrate storage container 162 and its relationship and interconnection to mobile office system 100*c*. Storage container 162 can be soft-shelled (e.g., leather, fabric, polyester, nylon, canvas, etc). FIG. 6A shows storage container 162 having one or more connectors 164. Connectors 164 can comprise straps, clips, zippers, or the like. Connectors 164 can enable a user to selectively couple storage container 162 to mobile office system 100*c*. As such, mobile office system 100*c* can have corresponding straps, clips, zippers, or similar connectors to interface with connectors 164. FIGS. 17A-17F show various embodiments of mobile office systems (100*l*-*q*) interfacing with a storage container. In at least one embodiment, connectors 164 can be disposed on a plurality of edges, sides, or faces of storage container 162. FIG. 6B shows storage container 162 includes access to an internal space by way of zipper 166, or by a similar securing means.

Figure 6C:
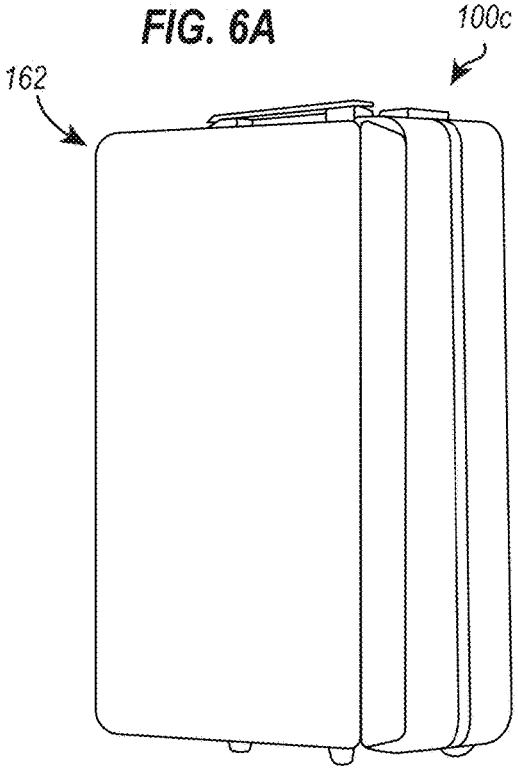
FIG. 6C illustrates a storage container of the present disclosure in relation to a mobile office system of the present disclosure.

FIG. 6C shows storage container 162 selectively coupled to mobile office system 100*c*. A user will appreciate the selective coupling of extra storage to their mobile office system 100*c* as it allows them to store additional items during their travels in a system that is detachable. For example, should a user not need extra storage capabilities of storage container 162 for a given outing or trip, they can remove or uncouple storage container 162. Additionally, a user can remove storage container 162 and place it under their seat on a plane while placing their mobile office system 100*c* in an overhead bin should they both not fit into the overhead bin.

Figure 6D:
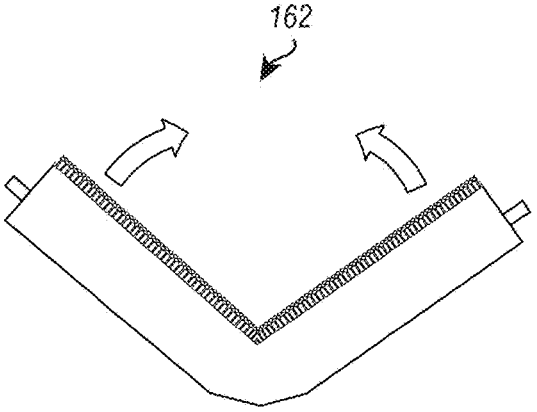
FIG. 6D illustrates a storage container of the present disclosure.

FIG. 6D shows that zipper 168 can allow storage container 162 to be folded and secured into a more condensed state. Straps or clips can replace zipper 168 and allow a user to fold or condense the footprint of the storage container 162. Additionally, when folded, storage container 162 can have straps or handles affixed that allow a user to carry storage container 162 like a duffle bag.

In one embodiment, a storage container can be a hard shell or be a rigid container. A user can selectively couple one or more hard-shelled or soft-shelled storage containers to a mobile office system 100 at the same time. For example, a user can couple a hard-shelled storage container to a face of their mobile office system 100*c* and then couple an additional storage container to a face of the hard-shelled storage container.

Figure 7A:
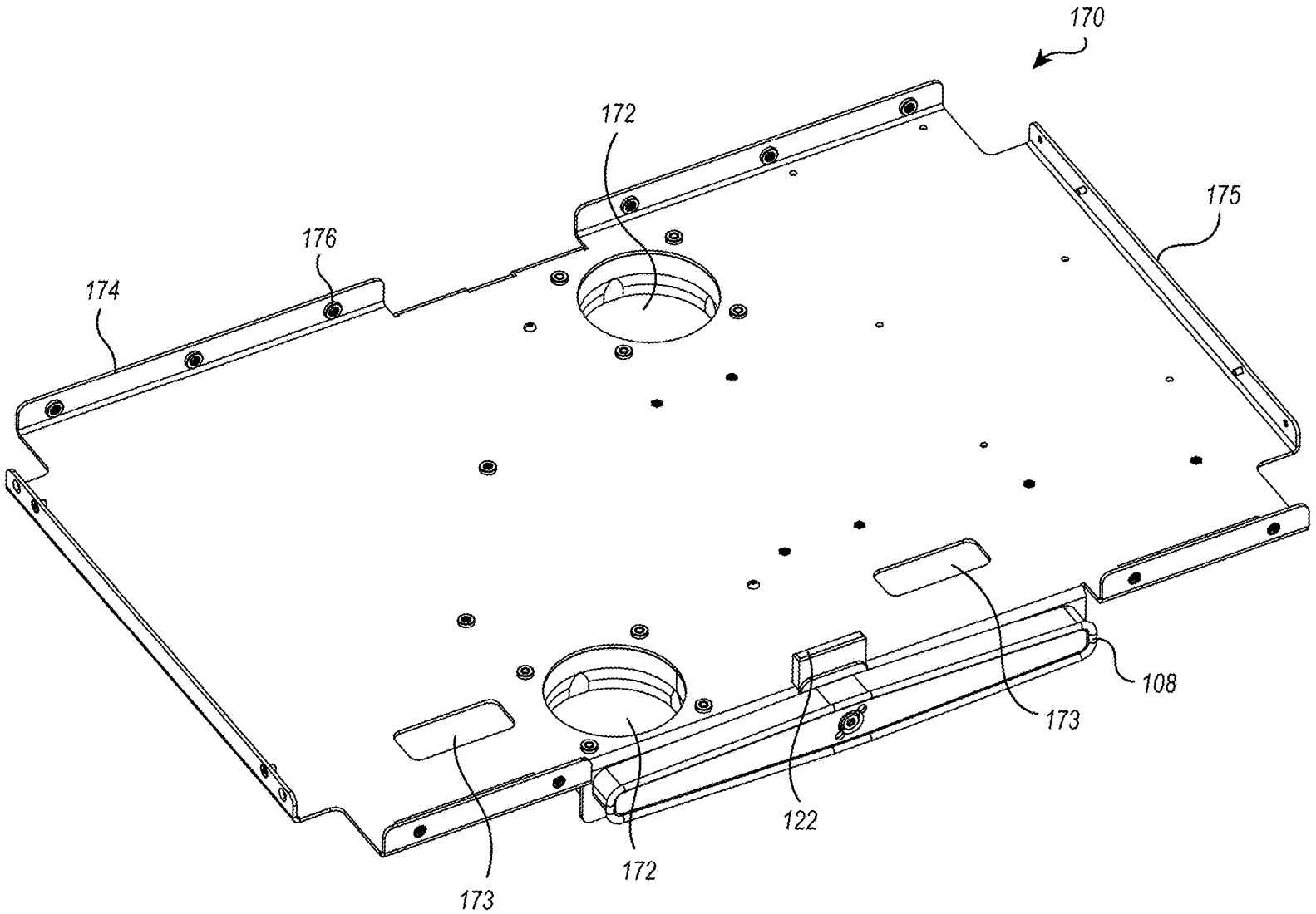
FIG. 7A illustrates a bottom, left front perspective view of a chassis of the present disclosure.

FIG. 7A illustrates an exemplary view of chassis 170. A manufacturer can construct chassis 170 from a plurality of components or from a single formed or pressed member. Chassis 170 can include one or more apertures 172 and 173, one or more supports 174 and 175, a release 122, and a foot 108 attached to a leg (not shown). Apertures 172 allow for the passage of air through chassis 170 to reach components and a screen mounted to chassis 170. A manufacturer can mount one or more fans adjacent to apertures 172 to increase the airflow. Apertures 173 can provide access to components or to a screen. For example, a manufacturer can pass wires through apertures 173.

FIG. 7A illstrates a bottom, left front perspective view of a chassis of the present disclosure. In particular, FIG. 7A shows supports 174 and 175 disposed along the outer edges of chassis 170. Supports 174 and 175 can provide structural rigidity to chassis 170 to prevent chassis 170 from bending. Support 174 can have a plurality of mounting holes 176 configured to secure to a shell of a protective case of the present disclosure. A manufacturer can use rivets, fasteners, adhesives, or the like to secure chassis 170 to a protective case. The rivets, fasteners, or the like can be secured through the exterior shell of the protective case. A manufacturer can configure support 175 to couple to a screen selectively. Connecting features or apertures can be disposed along supports 175 to enable such coupling.

Figure 7B:
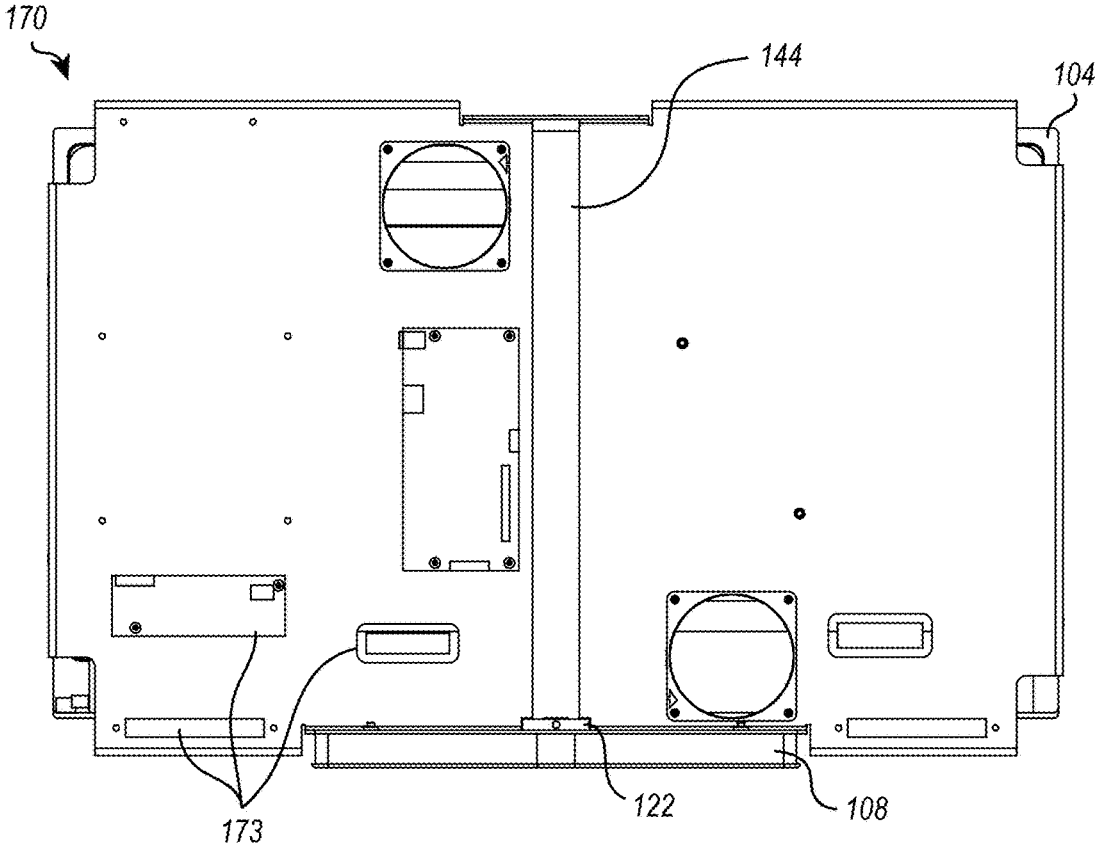
FIG. 7B illustrates a rear plan view of the chassis of FIG. 7A.

FIG. 7B illustrates a rear perspective view of chassis 170. FIG. 7B shows stand housing 144 secured to or a part of chassis 170. Stand housing 144 is a rigid enclosed volume that receives a stand or leg of the present disclosure. FIG. 7B shows foot 108 in a stowed position as the leg it is coupled to is fully received inside of its internal volume. In one embodiment, stand housing is a separate and distinct member and not part of chassis 170.

Figure 7C:
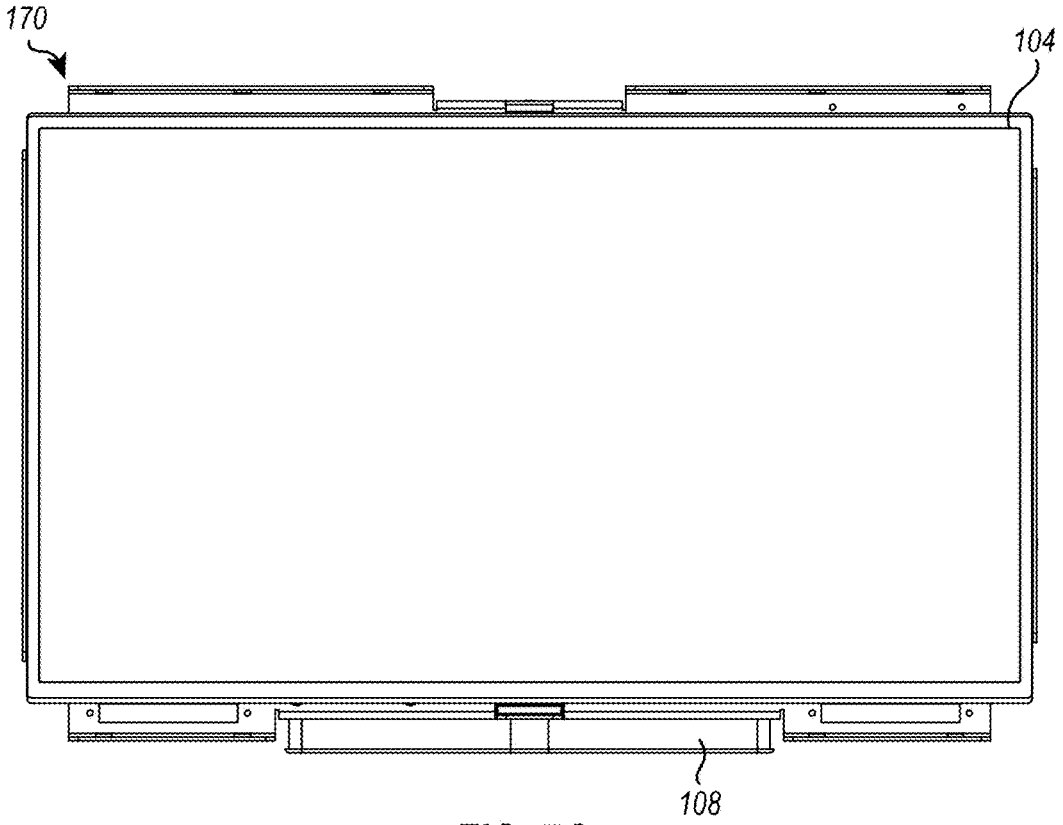
FIG. 7C illustrates a front face view of the chassis of FIG. 7A further including an attached display screen.

Further, FIGS. 7B and 7C show screen 104 secured to chassis 170. Chassis 170 provides structure to the protective case and to screen 104. Release 122 can also be seen. Release 122 can comprise a spring-loaded mechanism that enables the release and retention of a leg. Release 122 can have a pin inserted into a groove, aperture, slot, notch, or indentation along a leg, enabling release 122 to lock the leg into place. The leg can have one or more grooves, apertures, or indentations along its length to allow for multiple points of adjustment and retention.

FIG. 7C illustrates a front-face view of the chassis of FIG. 7A, further including a screen. As shown, screen 104 is secured to chassis 170 along its left and right sides (e.g. its vertically oriented sides).

Figure 8A:
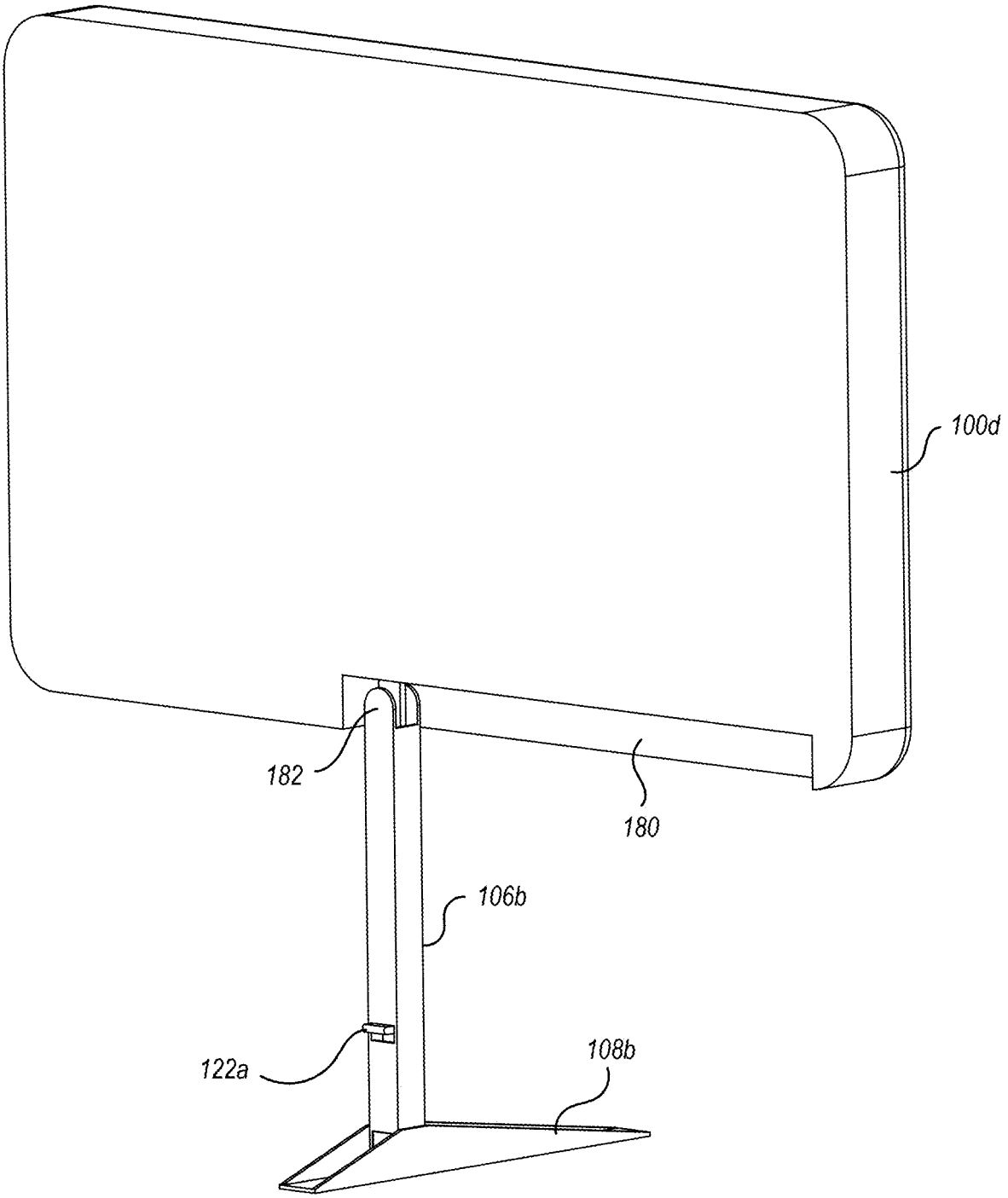
FIG. 8A illustrates an embodiment of a leg of the present disclosure.
Figure 8B:
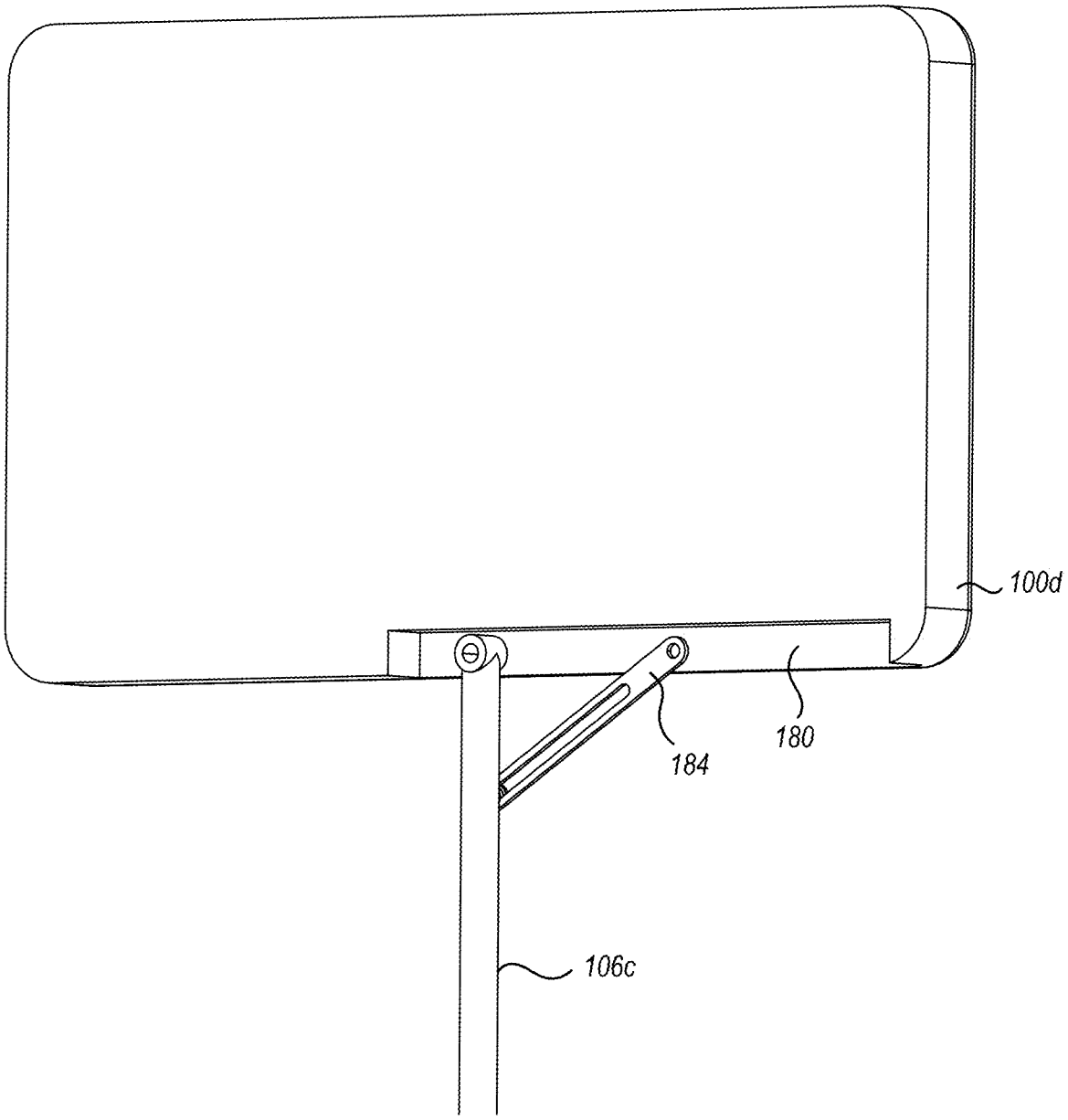
FIG. 8B illustrates another embodiment of a leg of the present disclosure.

FIGS. 8A-8B illustrate embodiments of legs of the present disclosure Specifically, FIG. 8A illustrates a rotatable leg, leg 106*b*. Leg 106*b* is a rotatable leg that is contained within space 180 when stowed. Space 180 can comprise an internal volume within the mobile office system 100*d*. A user can operate release 122*a* to allow leg 106*b* to rotate about axis 182. Axis 182 can comprise a bearing, pivot, or a similar point of rotation mechanism. Once rotated into a deployed position (shown in FIG. 8A), a user can then rotate and secure foot 108*b* into a deployed position. A user can fold foot 108*b* outward from leg 106*b* to provide stability. A user will appreciate that when in a stowed state, foot 108*b* (or any of the feet of the present disclosure) cannot be deployed accidentally as the foot abuts the leg within an internal space of the mobile office system, restricting its ability to rotate. In at least one embodiment, a manufacturer can install a release or latch to prevent the unwanted rotation of the foot.

FIG. 8B shows leg 106*c* in a deployed state. Like leg 106*b*, leg 106*c* is rotatable and can fold out from a space, (see space 180 in FIGS. 8A and 8B). Leg 108*c* has a strut 184 that interfaces with leg 106*c*, providing rotational support and stability when deployed.

Figure 9A:
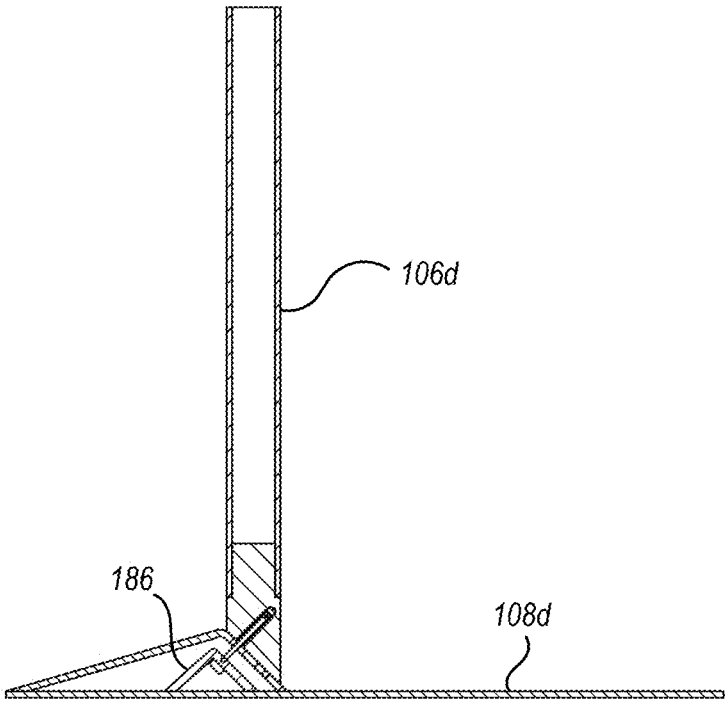
FIG. 9A illustrates an embodiment of a foot of the present disclosure.
Figure 9B:
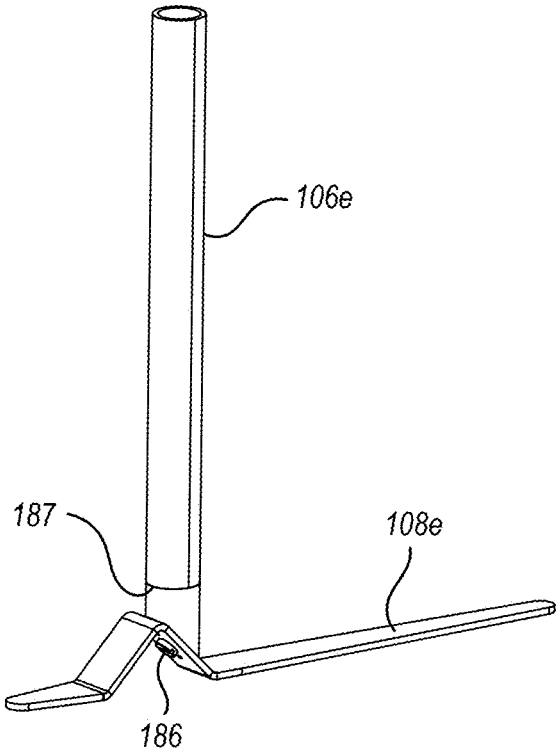
FIG. 9B illustrates another embodiment of a foot of the present disclosure.

FIGS. 9A-9B illustrate embodiments of legs and feet of the present disclosure. Specifically, FIG. 9A shows a cylindrical leg 106*d* having a joint 186 that mechanically connects it to foot 108*d*. Joint 186 is about 45 degrees off the major axis of leg 106*d* to minimize any wobbling and increase the overall stability of the mobile office system, such as mobile office system 100, it is connected to. The major axis can be defined by the direction of the length of the leg. Additionally, the angled nature of joint 186 allows a user to rotate foot 108*d* into a position that runs parallel to leg 106*d* when they store leg 106*d*. As such, this minimizes the overall space leg 106*d* and 108*d* take up when stowed. FIG. 9B shows a similar embodiment of a foot and leg, as shown in FIG. 9A. However, leg 106*e* also has a joint 187 that allows a user to rotate foot 108*e* about the axis of leg 106*e*. Users will appreciate the additional adjustability as they can account for a smaller or larger surface by rotating one or more feet 108*e* to mount firmly to a surface.

Figure 10:
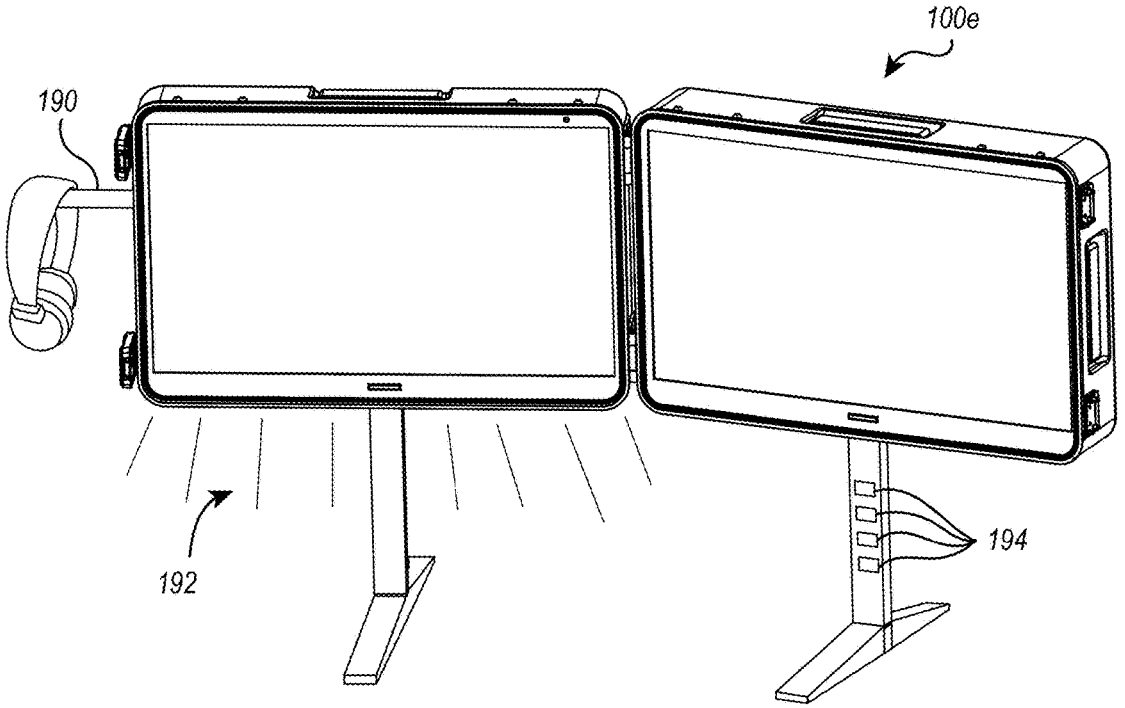
FIG. 10 illustrates an embodiment of a mobile office system of the present disclosure in a fully extended and expanded for use state.

FIGS. 10-16 illustrate embodiments of a mobile office system 100*e*-*k* of the present disclosure. For example, FIG. 10 shows a mobile office system 100*e* with a swinging or rotatable arm 190 designed to hold headphones. Arm 190 can comprise a single arm or a multipart arm. Arm 190 can rotate horizontally or vertically relative to a deployed mobile office system 100*e*. Arm 190 can have a catch, hook, or indexing element disposed at its distal end. Mobile office system 100*e* can have one or more lights 192. As shown, lights 192 are embedded or disposed on the lower surface of mobile office system 100*e* when deployed. A user can use lights 192 to illuminate a keyboard, paperwork, or a work-surface generally. In another embodiment, one or more lights can be installed in or around the bezel of a mobile office system. Mobile office system 100*e* can have a button interface 194 embedded within or disposed on one or more of its legs. Button interface 194 can operate lights 192, one or more of the screens within mobile office system 100*e*, or alter the state of any other electronics that are apart of mobile office system 100*e*.

Figure 11:
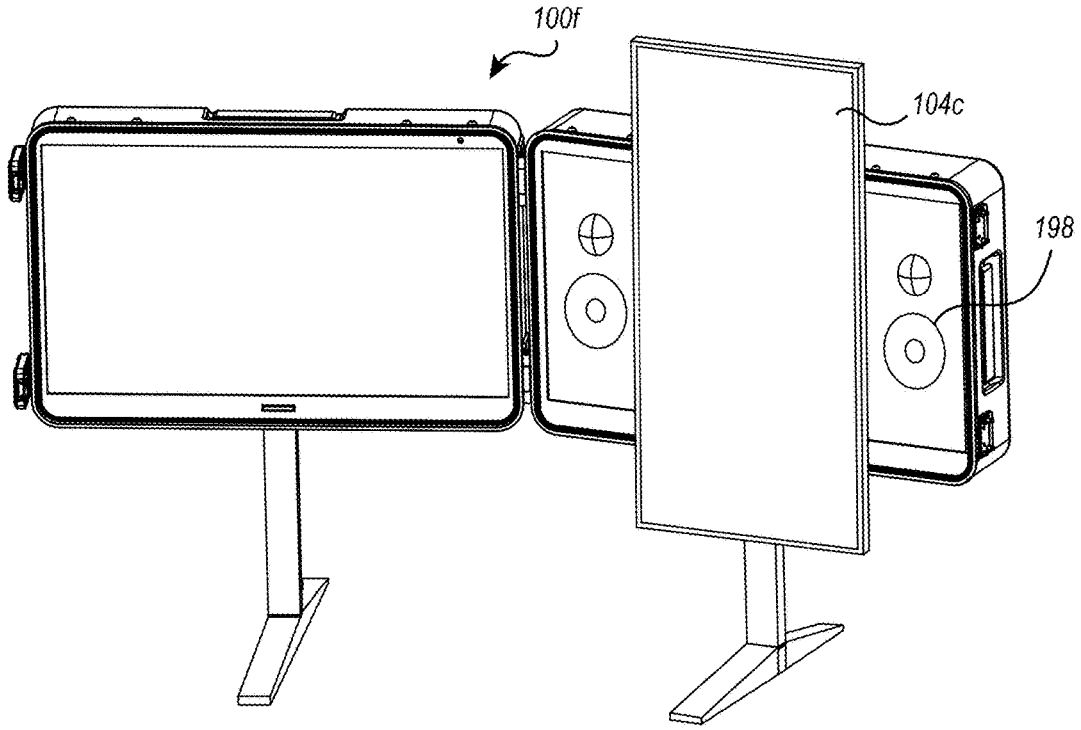
FIG. 11 illustrates an embodiment of a mobile office system of the present disclosure in which at least one screen is rotated.

FIG. 11 illustrates mobile office system 100*f*. Mobile office system 100*f* has a pivotable or rotatable screen 104*c* and a sound system 198, such as a rotatable attachment point (not shown) behind the monitor and connected to the chassis 170. A user can manipulate screen 104*c* such that it is rotated about its center point and is turned 90 degrees. This allows a user to use one or more of the screens in a vertical orientation, should a user prefer a vertically oriented screen when working. Once rotated, screen 104*c* can reveal sound system 198. Sound system 198 has one or more speakers (including but not limited to subwoofers, tweeters, and mid-range speakers). A manufacturer can wire sound system 198 into mobile office system 100*f* or provide wireless connectivity to sound system 198. Sound system 198 can also be embedded or installed behind or adjacent to a non-pivotable screen.

Figure 12:
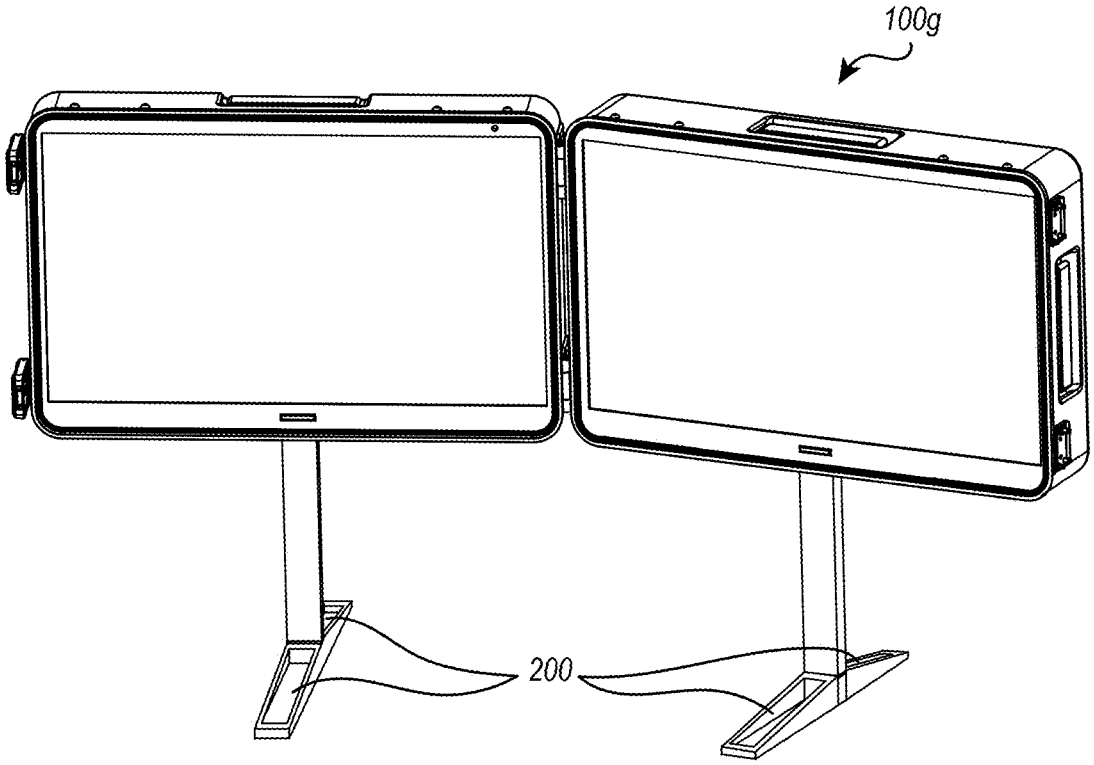
FIG. 12 illustrates another embodiment of a mobile office system of the present disclosure.

FIG. 12 illustrates a mobile office system 100*g*. Mobile office system 100*g* has one or more storage slots 200. Storage slots 200 can be embedded into the feet of mobile office system 100*g*. In one embodiment, storage slots 200 can have corresponding access hatches or doors. A manufacturer can design storage slots 200 to retain cables to be used in the operation of mobile office system 100*g*. A user can store any suitable item within storage slot 200 while mobile office system 100*g* is deployed and, in some embodiments, while mobile office system 100*g* is stowed.

Figure 13:
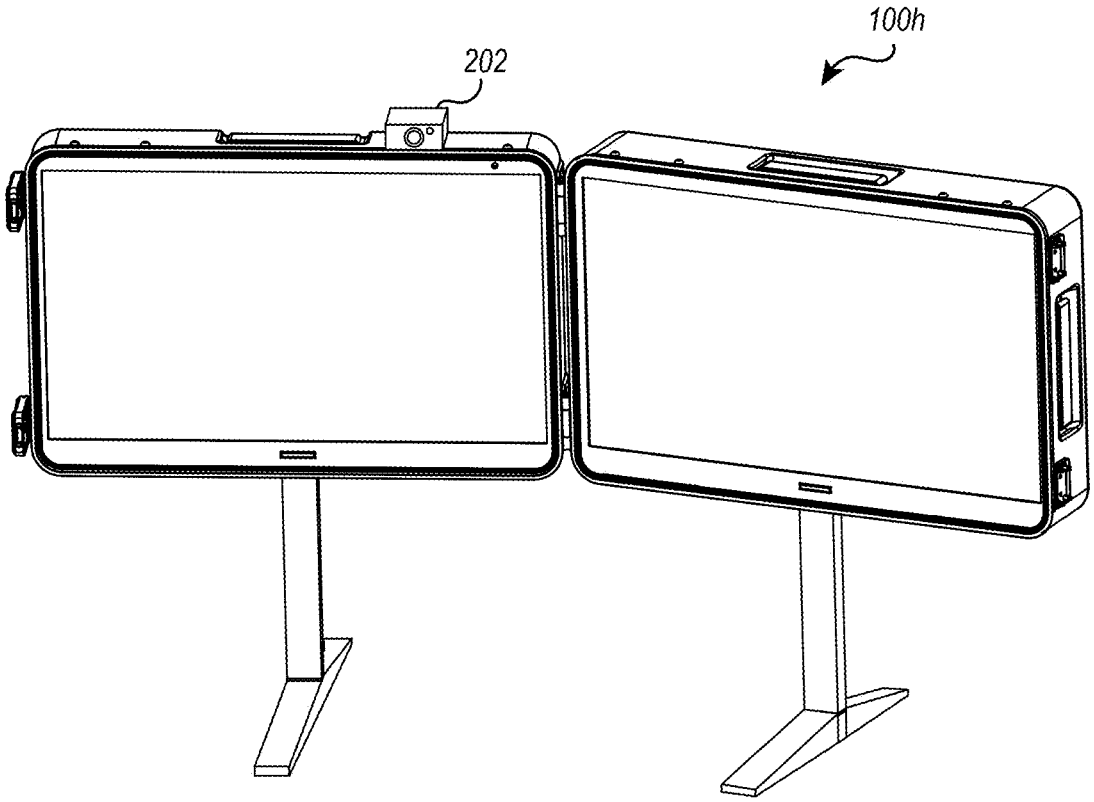
FIG. 13 illustrates a further embodiment of a mobile office system of the present disclosure.

FIG. 13 illustrates a mobile office system 100*h* having a mount 202. A manufacturer can fix mount 202 permanently to mobile office system 100*h*, or they can allow mount 202 to be removable. For example, mount 202 can be retained in a storage compartment of a given embodiment, and a user can selectively secure mount 202 to a corresponding coupler or mounting system embedded in or disposed on a mobile office system 100*h*. A manufacturer can design mount 202 to secure a camera to a mobile office system 100*h*.

Figure 14:
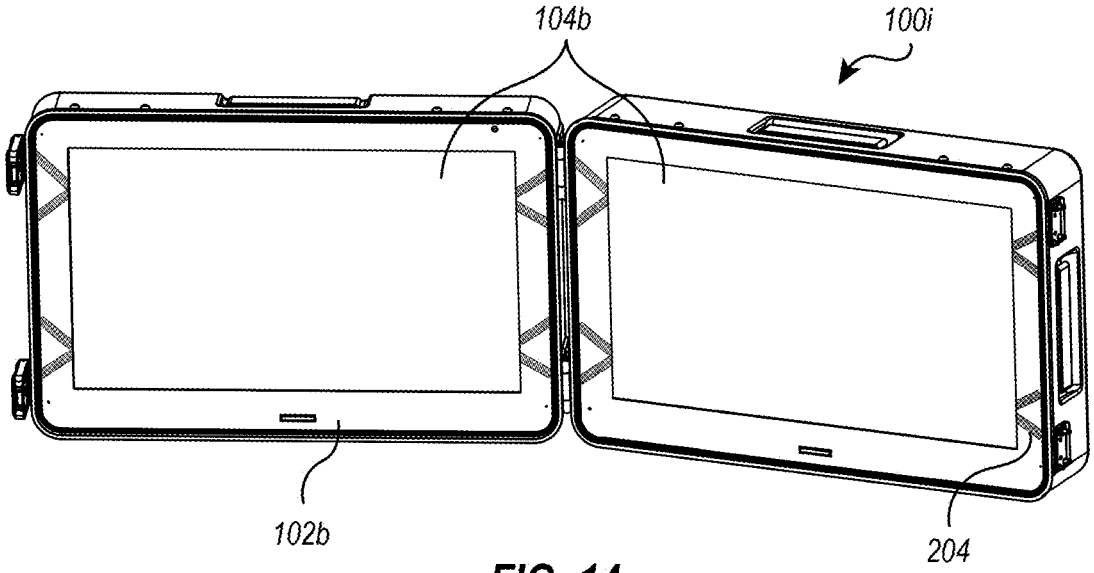
FIG. 14 illustrates still further an embodiment of a mobile office system of the present disclosure.

FIG. 14 illustrates mobile office system 100*i* having one or more suspensions 204. FIG. 14 shows eight suspensions 204 coupling screens 104*b* to protective case 102*b*. Suspensions 204 can comprise springs, straps, bands, or similar means designed to provide shock-absorbing qualities to mobile office system 100*i*. For example, if a user dropped their mobile office system 100*i*, suspension 204 could protect screens 104*b* from the forces caused by the drop. In one embodiment, a manufacturer can install one or more suspension means on or around a chassis of the present disclosure. In another embodiment, the suspension means can be installed between the screen and the chassis.

Figure 15:
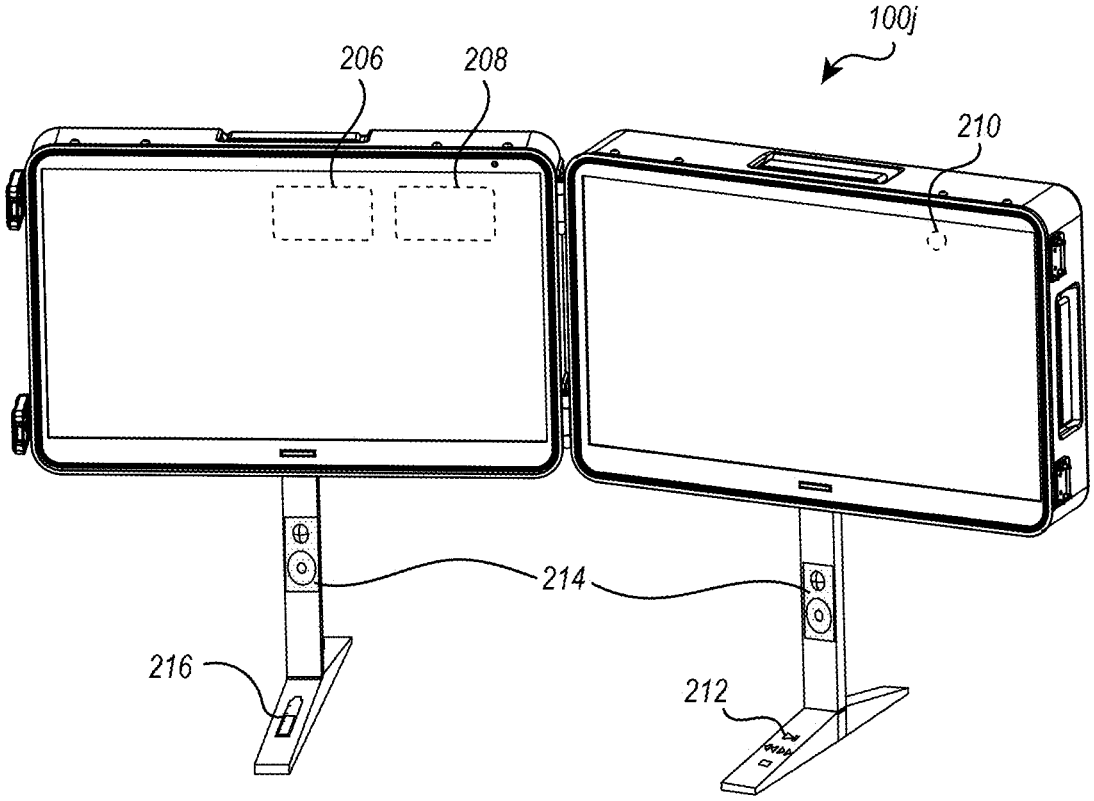
FIG. 15 illustrates a yet still further embodiment of a mobile office system of the present disclosure.

FIG. 15 illustrates mobile office system 100*j* having communication modules 206 and 208, transponder 210, battery (not shown), interfaces 212 and 216, and speakers 214. FIG. 15 shows communication modules 206 and 208 embedded into the protective case of mobile office system 100*j*. In one embodiment, a manufacturer can install one or more communications modules behind the screens of a mobile office system. Communication modules 206 and 208 can include but are not limited to: Bluetooth, WIFI, Cellular, RFID (Radio Frequency Identification), NFC (Near Field Communication), Zigbee, LoRa (Long Range), UWB (Ultra-Wideband), satellite communication, infrared (IR), Ethernet, or the like. A user will appreciate the wireless connectivity provided by such communication modules as it allows for the wireless use of mobile office system 100*j* and its internal components (screens, data storage, processor, memory, etc.)

FIG. 15 shows transponder 210 also embedded into or secured to mobile office system 100*j*. Transponder 210 can have its own battery to allow for long-term or continued operations. Transponder 210 can enable location tracking, monitoring, and retrieval. For example, if a user misplaced or has their mobile office system 100*j* stolen, transponder 210 can relay its position via a network of nearby devices to provide real-time location updates. Accordingly, this functionality ensures enhanced security, easy tracking, and recovery of the invention in various environments like traveling.

FIG. 15 shows speakers 214 integrated into the legs of mobile office system 100*j* and an interface 212 designed to operate or control the operation of the screens or speakers 214. As previously described, a manufacturer can allow wired or wireless connectivity to the speakers. For example, a user's device connected via a cable to a mobile office system 100*j* can play audio directly through speakers 214, or a wireless connected device connected to mobile office system 100*j* can also play audio directly through speakers 214. Interface 212 can include individually operatable buttons, switches, knobs that have predefined control over speakers 214, a device connected to mobile office system 100*j*, or the screens of mobile office system 100*j* (e.g. pause/play, volume, selection, skip, etc). A manufacturer can embed interface 212 into the legs, feet, or on a bezel around the screens of mobile office system 100*j*.

FIG. 15 shows that interface 216 is also embedded into the foot of the mobile office system 100*j*. Interface 216 is a screen designed to present relevant information regarding a battery onboard mobile office system 100*j*.

Figure 16:
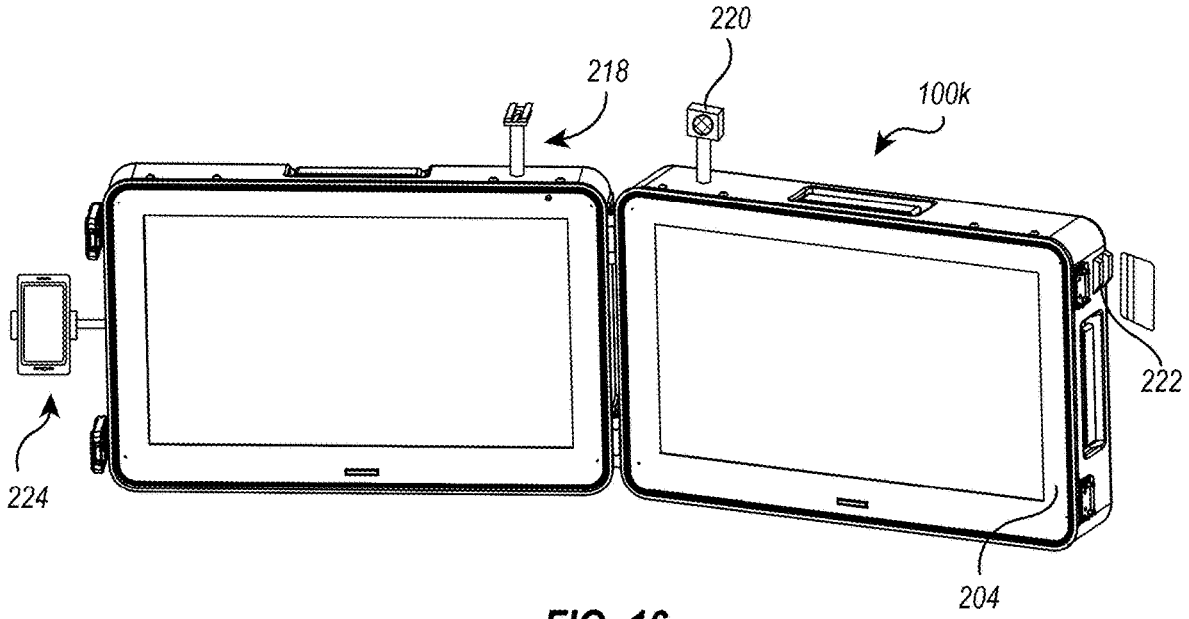
FIG. 16 illustrates an even further embodiment of a mobile office system of the present disclosure.

FIG. 16 illustrates a mobile office system 100*k* having devices 218 and 220, reader 222, and holder 224. Devices 218 and 220 can be telescoping or extendable supports designed to present a camera or a microphone. For example, a user can extend device 218 and 220 out from a stowed internal position within the mobile office system 100*k* to gain access and use a camera or a microphone. A user will appreciate the storability and adjustability of devices 218 and 220. In the case of a camera, should the mobile office system 100 be too short, even when deployed for a user to operate a camera embedded into its bezels comfortably, a user can extend and manipulate devices 218 or 220 to position an integrated camera to a more comfortable or natural position. The adjustability also allows for a camera or microphone to be pointed at a user who may not be directly in front of the screen of mobile office system 100*k*.

FIG. 16 shows that reader 222 can be embedded into mobile office system 100*k* to provide the functionality of reading credit cards, debit cards, bank cards, or the like. FIG. 16 also shows that holder 224 can extend from mobile office system 100*k*. Similar to arm 190 or devices 218 or 220, holder 224 allows for the versatile support of a device by mobile office system 100*k*. For example, FIG. 16 shows holder 224 supporting a mobile phone. Holder 224 can have an embedded wireless charging module that can give the mobile phone power, and holder 224 can be a clamping or magnetic system that holds the mobile phone into place.

In at least one embodiment, a manufacturer can install an extendable or couplable privacy screen. A privacy screen can be a semi-transparent film layer that abuts a screen, making viewing difficult for third parties far away or off a perpendicular view axis from the screens. A privacy screen can also be walls, flaps, or another non-transparent blocker that physically blocks the line of sight of the screen unless a user is within a pre-defined viewing axis.

Figure 17A:
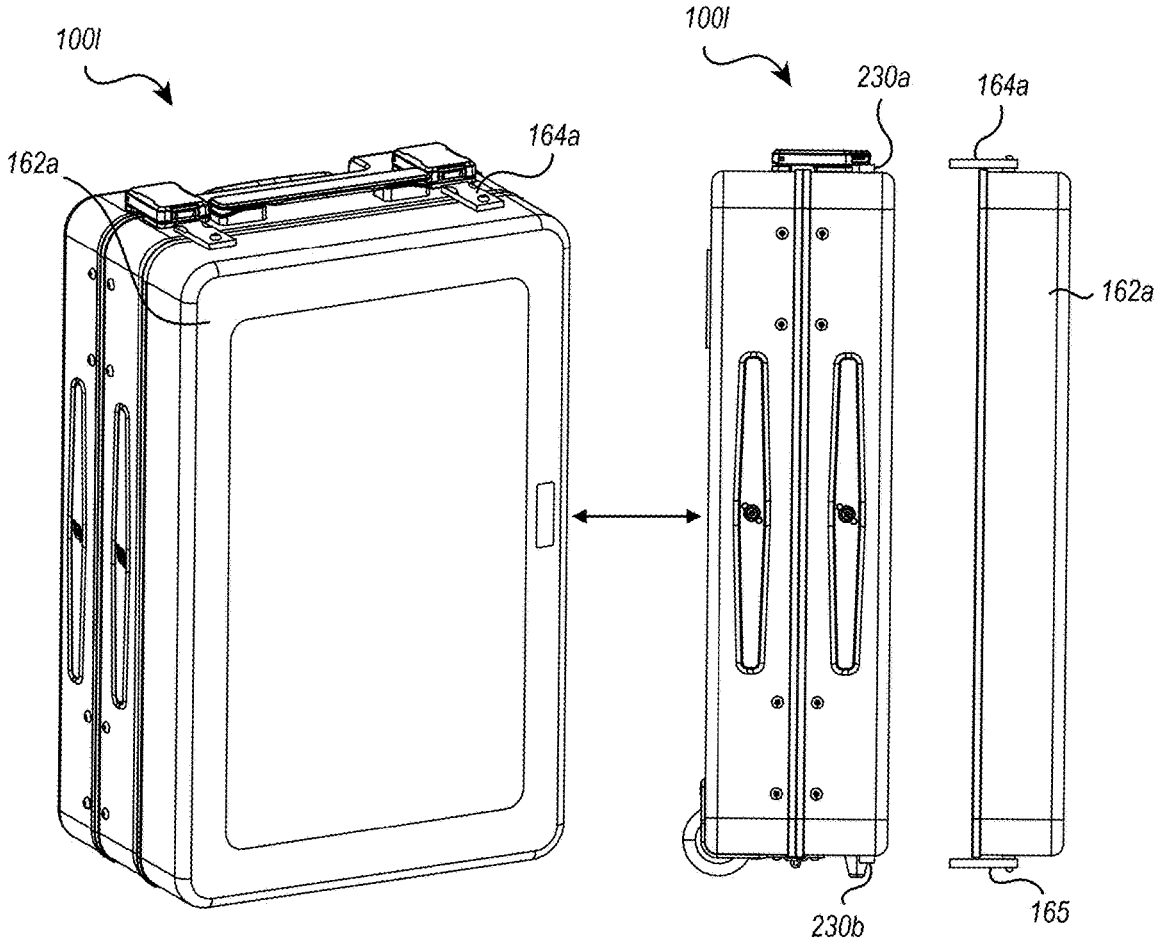
FIG. 17A illustrates various view of a storage container connected to a mobile office system of the present disclosure.

FIGS. 17A-17F illustrate various ways a storage container 100L can be secured to or coupled to a mobile office system. Each system 100L through 100Q is labeled with a specific storage container label of 162*a* through 162*f* for purposes of convenience, although one will appreciate that the latches may vary even if the storage containers 162(*a-f*) otherwise remain substantially similar. For example, FIG. 17A shows various perspectives of mobile office system 100L and storage container 124*a*. Storage container 162*a* can be hard-shelled or soft-shelled. Storage container 124*a* can include a connector 164*a* and 165. Connector 164*a* can be a manual latch configured to selectively couple with connection element 230*a*. Connector 165 can be a hook or hook-like feature that is configured to connect with connection element 230*b*. A user can hook or couple connector 165 to connection element 230*b* and then couple connector 164*a* to connection element 230*a*, to thereby secure storage container 162*a* to the other storage container(s) of 100L. Thus, connection element connector 164*b* can be a spring latch, clip latch, rotating latch, flip latch, or a similar latch.

Figure 17B:
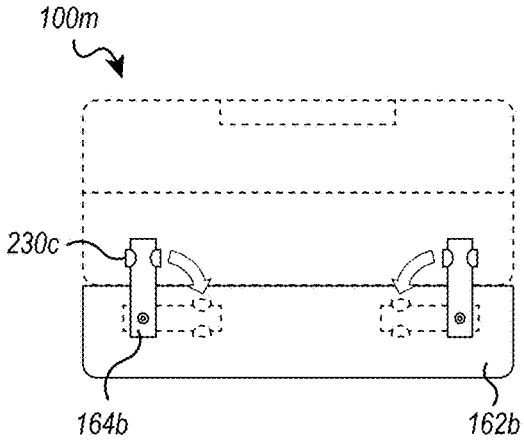
FIG. 17B illustrates a top view of a closed storage container connected to a mobile office system of the present disclosure.
Figure 17C:
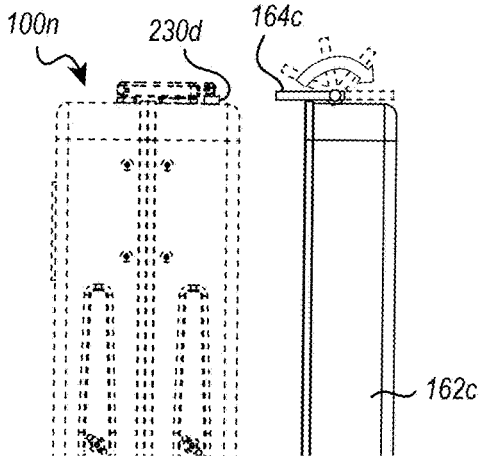
FIG. 17C illustrates a side view of a closed storage container connected to a mobile office system of the present disclosure.

FIGS. 17B and 17C illustrate connectors 164*b* (connecting storage container 162*b*) and 164*c*(connecting storage container 162*c*), respectively within the corresponding systems 100*m* and 100*n*, respectively. For example, FIG. 17B shows connector 164*b*, which can be a pivoting mechanism for connecting system 100*m*. Users can stow connector 164*b* or pivot it outwards to interface with connection element 230*c*. A manufacturer can install one or more connectors 164*b* on a given embodiment.

FIG. 17C shows connector 164*c*, which can be a flip latch for connecting storage component 162*c* within system 100*n*. Connector 164*c* can be stowed in a recess along the surface of storage container 162*c*. Users can flip or rotate connector 164*c* to interface with connection element 230*d*. A manufacturer can install one or more connectors 164*c* on a given embodiment.

Figure 17F:
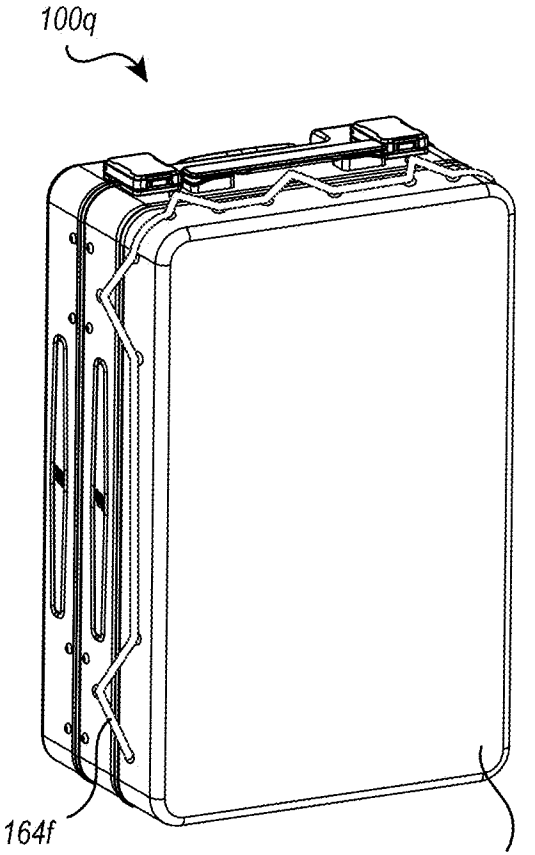
FIG. 17F illustrates a still further embodiment of a storage container connected to a mobile office system of the present disclosure.
Figure 17E:
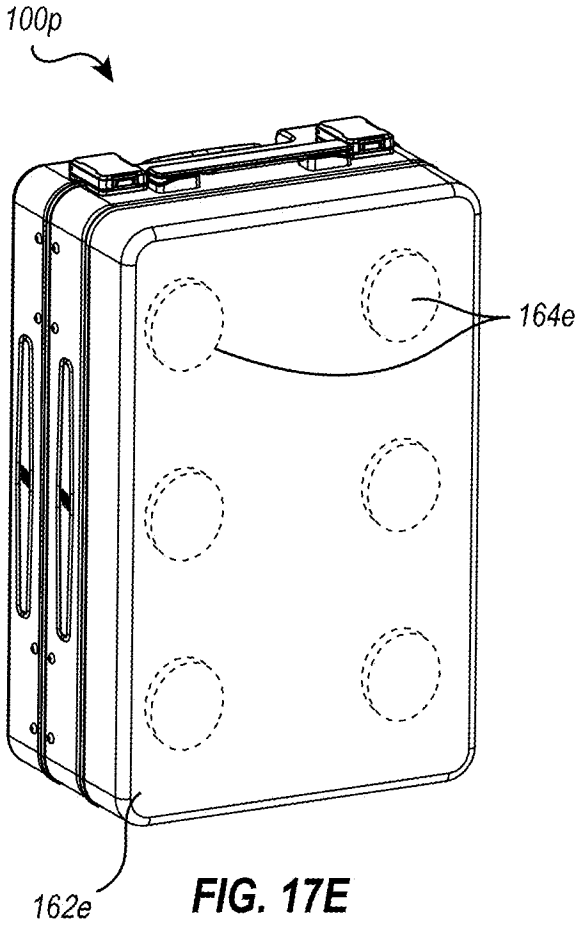
FIG. 17E illustrates a further embodiment of a storage container connected to a mobile office system of the present disclosure.
Figure 17D:
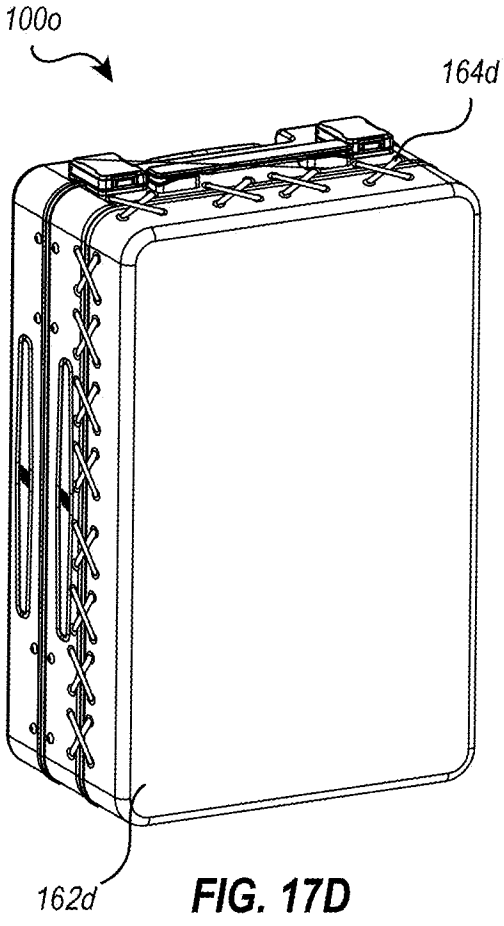
FIG. 17D illustrates another embodiment storage container connected to a mobile office system of the present disclosure.

FIG. 17D illustrates storage container 162*d* coupled to mobile office system 1000 using connector 164*d*. Connector 164*d* can be a zipper or zipper-style mechanism.

FIG. 17E illustrates storage container 162*e* coupled to mobile office system 100*p* using connector 162*e*. Connector 164*e* can be a magnet or array of magnets configured to interface with magnets or magnetic material embedded or connected to mobile office system 100*p*.

FIG. 17F illustrates storage container 162*f* coupled to mobile office system 100*q* using connector 162*f*. Connector 164*f* can be one or more elastic straps configured to interface with connection elements disposed on mobile office system 100*q*.

Accordingly, one of ordinary skill will appreciate in view of the present disclosure and claims that mobile office systems of the present disclosure can provide a traveler with an office-like experience anywhere when deployed the enclosed systems. In particular, the inventive mobile office systems can include one or more screens, one or more chassis to support the screens, a protective case (similar to a conventional carry-on suitcase), and the electronic components and cables needed to drive and support the use of the screens to enable ease and efficiency of use, both in packing and travel, as well (and more importantly) with end use in a travel location. Unlike conventional travel screens, mobile office systems of the present disclosure are more robust and allow for the use of full-sized screens more typically found in an office environment (24", 27", 30", etc.) rather than the smaller-sized conventional travel screens (13"). Additionally, when stowed, a user can easily transport a mobile office system of the present disclosure, similar to a conventional carry-on suitcase, i.e. rolling or carrying the mobile office system.

Mobile office systems of the present disclosure are also easy to use due to the integrated nature of the screens. A user can use a singular data/power cable to connect their laptop or device to the mobile office system. This means a user's computer can charge while the user operates the screens. An extendable or attachable single power cable also means that a user only has to extend a single cable to keep the mobile office system and their computer running for the duration of their work session. Only a single cable (the data/power cable connecting a device to the mobile office system) is needed when a battery is present within the mobile office system.

A user will appreciate the adjustability of mobile office systems of the present disclosure due to the legs that may be extended or connected to the system. To provide a more ergonomic arrangement, a user may extend legs and feet from a stowed position to raise and position the screens within the mobile office system. A user can clip or couple legs to the mobile office system in at least one embodiment. For example, legs can be stored inside a compartment of a mobile office system, and a user can remove the legs from their compartment and clip, couple, or otherwise interface the legs to corresponding mounts, clips, or connectors. In such an example, a manufacturer may not include internal extendable or rotatable legs. Once deployed or connected, the legs and feet rigidly support the mobile office system and prevent the system from toppling over.

A manufacturer can include storage compartments and containers that are internal volumes or external storage devices that provide a user with storage for clothing, toiletries, paperwork, computers, or other things they may need during their travels. The selective coupling of a storage container also means that a user can remove their storage container to account for limited space in an overhead airplane bin or to be able to carry their traveling items separately from their mobile office system.

In one implementation, a rigid chassis may not be used, and instead, a manufacturer can use straps, frame members, foam, or mounts to secure one or more screens to the protective case. Additionally, a manufacturer can directly mount the screens to the frame of the protective case. For example, a protective case may contain one or more computer monitors in a manner that protects the monitors from shaking or dropping the case, thereby preventing any physical damage to the monitors. This may include the use of foam padding, rubber pads, or any suitable shock absorption material or device.

The following discussion is intended to provide a brief, general description of a suitable computing environment in which the present disclosure may be implemented. Although not required, the present disclosure will be described in the general context of computer-executable instructions, such as program modules, being executed by computers in network environments. Generally, program modules include routines, programs, objects, components, data structures, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

Those skilled in the art will appreciate that the present disclosure may be practiced in network computing environments with many types of computer system configurations, including personal computers, hand-held devices, multiprocessor systems, microprocessor-based or programmable consumer electronics, network PCs, minicomputers, mainframe computers, and the like. The present disclosure may also be practiced in distributed computing environments where local and remote processing devices perform tasks and are linked (either by hardwired links, wireless links, or by a combination of hardwired or wireless links) through a communications network. In a distributed computing environment, program modules may be located in both local and remote memory storage devices.

The present disclosure may comprise or utilize a special-purpose or general-purpose computer system that includes computer hardware, such as, for example, a processor and system memory, as discussed in greater detail below. The scope of the present disclosure also includes physical and other computer-readable media for carrying or storing computer-executable instructions and/or data structures. Such computer-readable media can comprise any available media that can be accessed by a general-purpose or special-purpose computer system. Computer-readable media that store computer-executable instructions and/or data structures are computer storage media. Computer-readable media that carry computer-executable instructions and/or data structures are transmission media. Thus, by way of example, and not limitation, the present disclosure can comprise two distinctly different kinds of computer-readable media: computer storage media and transmission media.

Computer storage media are physical storage media that store computer-executable instructions and/or data structures. Physical storage media include computer hardware, such as RAM, ROM, EEPROM, solid state drives ("SSDs"), flash memory, phase-change memory ("PCM"), optical disk storage, magnetic disk storage or other magnetic storage devices, or any other hardware storage device(s) which can be used to store program code in the form of computer-executable instructions or data structures, which can be accessed and executed by a general-purpose or special-purpose computer system to implement the disclosed functionality of the present disclosure.

Transmission media can include a network and/or data links which can be used to carry program code in the form of computer-executable instructions or data structures, and which can be accessed by a general-purpose or special-purpose computer system. A "network" is defined as data links that enable the transport of electronic data between computer systems and/or modules and/or other electronic devices. When information is transferred or provided over a network or another communications connection (either hardwired, wireless, or a combination of hardwired or wireless) to a computer system, the computer system may view the connection as transmission media. Combinations of the above should also be included within the scope of computer-readable media.

Further, upon reaching various computer system components, program code in the form of computer-executable instructions or data structures can be transferred automatically from transmission media to computer storage media (or vice versa). For example, computer-executable instructions or data structures received over a network or data link can be buffered in RAM within a network interface module, and then eventually transferred to computer system RAM and/or to less volatile computer storage media at a computer system. Thus, it should be understood that computer storage media can be included in computer system components that also (or even primarily) utilize transmission media.

Computer-executable instructions comprise, for example, instructions and data which, when executed at a processor, cause a general-purpose computer system, special-purpose computer system, or special-purpose processing device to perform a certain function or group of functions. Computer-executable instructions may be, for example, binaries, intermediate format instructions such as assembly language, or even source code.

Those skilled in the art will appreciate that the present disclosure may be practiced in network computing environments with many types of computer system configurations, including, personal computers, desktop computers, laptop computers, message processors, hand-held devices, multiprocessor systems, microprocessor-based or programmable consumer electronics, network PCs, minicomputers, mainframe computers, mobile telephones, PDAs, tablets, pagers, routers, switches, and the like. The present disclosure may also be practiced in distributed system environments where local and remote computer systems, which are linked (either by hardwired data links, wireless data links, or by a combination of hardwired and wireless data links) through a network, both perform tasks. As such, in a distributed system environment, a computer system may include a plurality of constituent computer systems. In a distributed system environment, program modules may be located in both local and remote memory storage devices.

Those skilled in the art will also appreciate that the present disclosure may be practiced in a cloud-computing environment. Cloud computing environments may be distributed, although this is not required. When distributed, cloud computing environments may be distributed internationally within an organization and/or have components possessed across multiple organizations. In this description and the following claims, "cloud computing" is defined as a model for enabling on-demand network access to a shared pool of configurable computing resources (e.g., networks, servers, storage, applications, and services). The definition of "cloud computing" is not limited to any of the other numerous advantages that can be obtained from such a model when properly deployed.

A cloud-computing model can be composed of various characteristics, such as on-demand self-service, broad network access, resource pooling, rapid elasticity, measured service, and so forth. A cloud-computing model may also come in the form of various service models such as, for example, Software as a Service ("SaaS"), Platform as a Service ("PaaS"), and Infrastructure as a Service ("IaaS"). The cloud-computing model may also be deployed using different deployment models such as private cloud, community cloud, public cloud, hybrid cloud, and so forth.

A cloud-computing environment, or cloud-computing platform, may comprise a system that includes a host that is capable of running virtual machines. During operation, virtual machines emulate an operational computing system, supporting an operating system and perhaps other applications as well. Each host may include a hypervisor that emulates virtual resources for the virtual machines using physical resources that are abstracted from view of the virtual machines. The hypervisor also provides proper isolation between the virtual machines. Thus, from the perspective of any given virtual machine, the hypervisor provides the illusion that the virtual machine is interfacing with a physical resource, even though the virtual machine interfaces with the appearance (e.g., a virtual resource) of a physical resource. Examples of physical resources including processing capacity, memory, disk space, network bandwidth, media drives, and so forth.

The present disclosure may be embodied in other specific forms without departing from its spirit or essential characteristics. The described examples are to be considered in all respects only as illustrative and not restrictive. The scope of the present disclosure is, therefore, indicated by the appended claims rather than by the foregoing description. All changes which come within the meaning and range of equivalency of the claims are to be embraced within their scope.

I claim:

1. A mobile office system comprising:

a protective case;

a first chassis selectively secured to an inside of the protective case;

a first computer monitor selectively secured to the first chassis;

a power cable operably connected to the monitor;

a data cable operably connected to the monitor; and an interface positioned between a first extension member and a second extension member of an extendable handle disposed on a third side of the mobile office system, wherein:

the mobile office system has a stowed state and a deployed state, the deployed state is configured to present the first computer monitor for external viewing, the first chassis comprising one or more apertures configured to receive a wire, the interface is configured to provide data and power transfer between the mobile office system and another electronic device, and the third side of the mobile office system is perpendicular to a first side and a second side.

2. The mobile office system of claim 1, wherein the protective case has a first shell and a second shell that are in hinged communication.

3. The mobile office system of claim 2, wherein the first chassis is in communication with the first shell.

4. The mobile office system of claim 3, further comprising:

a second computer monitor selectively secured to a second chassis, wherein the second chassis is secured inside of the second shell.

5. The mobile office system of claim 2, further comprising:

a first leg and a second leg, wherein the first leg is in mechanical communication with the first shell and the second leg is in mechanical communication with the second shell.

6. The mobile office system of claim 5, wherein the first leg and second leg are in mechanical communication with a release disposed on an internal surface of the mobile office system.

7. The mobile office system of claim 5, wherein:

the first leg and second leg are configured to telescopically extend to a deployed position from an internal stowed position, and the first and second legs each comprise a foot configured to stabilize the mobile office system at an elevated position relative to a surface on which the mobile office system is mounted.

8. The mobile office system of claim 5, wherein:

the first leg and second leg are configured to pivot to a deployed position from an internal stowed position;

the first and second legs are configured to stabilize the mobile office system at an elevated position relative to a surface on which the mobile office system is mounted; and a first strut provides rotational support to the first leg, and a second strut provides rotational support to the second leg.

9. The mobile office system of claim 5, wherein:

a first foot is in mechanical communication with the first leg, a second foot is in mechanical communication with the second leg, and a release is configured both to allow the first leg and the second leg to extend and to allow the first foot and the second foot to rotate.

10. The mobile office system of claim 9, wherein the first foot and the second foot are configured to rotate on an axis that is about 45 degrees relative to a major axis of the first and second legs.

11. The mobile office system of claim 1, further comprising a storage container that is configured for selective coupling to a face of the protective case via one or more connection elements disposed on at least one edge or face of the protective case.

12. The mobile office system of claim 1, further comprising one or more wheels disposed on a same side of the mobile office system as a hinge.

13. The mobile office system of claim 1, wherein a stowed state of the mobile office system provides an IP66 rating.

14. The mobile office system of claim 1, wherein the power cable is configured to extend from and retract into an internal space within the mobile office system using a spring-loaded spool.

15. The mobile office system of claim 1, wherein the first chassis is secured to a first shell of the protective case through an external surface of the protective case.

16. The mobile office system of claim 1, further comprising:

a bezel secured around a front face of the first computer monitor, wherein the bezel comprises one or more vents; and the vents are configured to allow for the passage of air to cool the mobile office system.

17. The mobile office system of claim 1, wherein a first leg is retained in an internal space defined by the first chassis.

18. A mobile office system comprising:

a protective case having a first shell and a second shell, wherein the first shell and the second shell are in hinged communication, and the protective case has a deployed state and a stowed state;

a first chassis selectively secured to the first shell, and a second chassis is selectively secured to the second shell;

a first computer monitor selectively secured to the first chassis and a second computer monitor selectively secured to the second chassis, wherein the first computer monitor and the second computer monitor are within an internal space of the first shell or the second shell, even in a deployed state;

a first leg in mechanical communication with a side of the first shell and a second leg in mechanical communication with the second shell, wherein the first and second legs are configured to support the mobile office system;

a first rotatable foot coupled to the first leg, wherein the first rotatable foot is rotatable about a lengthwise axis of the first leg;

an interface positioned between a first extension member and a second extension member of an extendable handle disposed on a side of the mobile office system that is perpendicular to the side of first shell in mechanical communication with the first leg, the interface configured for external operation to facilitate the transfer of power and data to and from the mobile office system and another electronic device; and a power cable and a data cable are operably connected to the first and second computer monitors.

19. A method of using the mobile office system of claim 1, comprising:

securing the first computer monitor to a first shell of a protective case;

securing a first leg to the first shell of the protective case;

securing a second computer monitor to a second shell of the protective case;

securing a second leg to the second shell of the protective case;

coupling the first shell to the second shell with a hinge;

operably connecting the first computer monitor and second computer monitor to a dock; and operably connecting an electronic device to the dock in the deployed state.

20. A mobile office system comprising:

a protective case having a first shell and a second shell that are in hinged communication;

a first chassis selectively secured to an inside of the protective case;

a first computer monitor selectively secured to the first chassis;

a power cable operably connected to the monitor;

a data cable operably connected to the monitor;

a first leg and a second leg;

a first foot is in mechanical communication with the first leg;

a second foot is in mechanical communication with the second leg; and a release is configured both to allow the first leg and the second leg to extend and to allow the first foot and the second foot to rotate, wherein:

the mobile office system has a stowed state and a deployed state, the deployed state is configured to present the first computer monitor for external viewing, the first chassis comprising one or more apertures configured to receive a wire, the first leg is in mechanical communication with the first shell, and the second leg is in mechanical communication with the second shell, and the first foot and the second foot are configured to rotate on an axis that is about 45 degrees relative to a major axis of the first and the second legs.

21. The mobile office system of claim 20, further comprising a storage container that is configured for selective coupling to a face of the protective case via one or more connection elements disposed on at least one edge or face of the protective case.

22. The mobile office system of claim 20, further comprising:

a bezel secured around a front face of the first computer monitor, wherein the bezel comprises one or more vents; and the vents are configured to allow for the passage of air to cool the mobile office system.

23. The mobile office system of claim 20, wherein a first leg is retained in an internal space defined by the first chassis.

* * * * *